US009284740B2

(12) United States Patent
Takagi et al.

(10) Patent No.: US 9,284,740 B2
(45) Date of Patent: Mar. 15, 2016

(54) MORTAR PEELING METHOD

(71) Applicant: Marutaka-Kogyo Inc., Tokyo (JP)

(72) Inventors: Kazumasa Takagi, Tokyo (JP); Eizou Takagi, Tokyo (JP); Masayuki Asakura, Tokyo (JP); Tatsuya Ida, Tokyo (JP)

(73) Assignee: Marutaka-Kogyo Inc., Tokyo (JP)

( * ) Notice: Subject to any disclaimer, the term of this patent is extended or adjusted under 35 U.S.C. 154(b) by 46 days.

(21) Appl. No.: 14/361,839

(22) PCT Filed: Dec. 5, 2012

(86) PCT No.: PCT/JP2012/081554
§ 371 (c)(1),
(2) Date: May 30, 2014

(87) PCT Pub. No.: WO2013/084956
PCT Pub. Date: Jun. 13, 2013

(65) Prior Publication Data

US 2015/0107570 A1 Apr. 23, 2015

(30) Foreign Application Priority Data

Dec. 6, 2011 (JP) ..... 2011-266735

(51) Int. Cl.

| | |
|---|---|
| ***B28D 1/18*** | (2006.01) |
| ***E04G 23/02*** | (2006.01) |
| ***B28D 1/00*** | (2006.01) |
| ***E04G 23/00*** | (2006.01) |

(52) U.S. Cl.
CPC ..... *E04G 23/0296* (2013.01); *B28D 1/00* (2013.01); *B28D 1/005* (2013.01); *B28D 1/18* (2013.01); *E04G 23/002* (2013.01)

(58) Field of Classification Search
CPC ..... B28D 1/00; B28D 1/005; E04G 23/02; E04G 23/00; E04G 23/0296; E04G 23/002
USPC ..... 125/9, 38
See application file for complete search history.

(56) References Cited

U.S. PATENT DOCUMENTS 4,182,000 A * 1/1980 Fairbairn ..... A47L 13/08 15/236.01

FOREIGN PATENT DOCUMENTS

| | | |
|---|---|---|
| DE | 2254525 | 5/1974 |
| DE | 2356527 | 5/1975 |

(Continued)

OTHER PUBLICATIONS

U.S. Appl. No. 14/361,815, filed May 30, 2014, Takagi et al.

*Primary Examiner* — Robert Rose
(74) *Attorney, Agent, or Firm* — Clark & Brody

(57) ABSTRACT

[Problem]
A mortar peeling method which can keep a sound generated during a peeling work to an allowable quiet sound and can peel a mortar off a concrete framework smoothly.
[Solution]
In a mortar peeling method, by gradually extending a piston rod 42 of a hydraulic jack 13 in a mortar peeling device 10A forward in one direction, a cutter 14 is gradually advanced forward in one direction so as to execute a mortar peeling process of peeling a mortar 21 with a predetermined thickness off a concrete framework 20 by using the cutter 14. In the mortar peeling method, after the piston rod 42 of the hydraulic jack 13 is extended forward in one direction and the mortar 21 is peeled, by retreating the piston rod 42 rearward in one direction, a session of the mortar peeling process is completed.

12 Claims, 18 Drawing Sheets

(56) References Cited

FOREIGN PATENT DOCUMENTS

| | | |
|---|---|---|
| DE | 3722546 | 1/1989 |
| DE | 3916186 | 11/1990 |
| JP | 01-315560 | 12/1989 |
| JP | 2001-081975 | 3/2001 |
| JP | 2005-002756 | 1/2005 |
| JP | 2011-153500 | 8/2011 |
| JP | 2011-174269 | 9/2011 |

* cited by examiner

MORTAR PEELING METHOD

TECHNICAL FIELD

The present invention relates to a mortar peeling method using a mortar peeling device for peeling mortar constructed on a concrete framework.

In a building, finishing is performed by constructing a mortar having a predetermined thickness on a surface of a concrete framework, but when a renovation work of the mortar after years have passed, an earthquake strengthening work by increasing a thickness of a wall or a ceiling or the like is required, prior to new finishing or thickness increasing, a peeling work of the mortar constructed on the surface of the concrete framework is performed. In the prior-art mortar peeling work, a user demolishes existing mortar by directly performing a chipping work using a small-sized rock drill or a hammer drill. However, since chipping machines such as the small-sized rock drill, a hammer drill and the like destroy mortar by applying vibration and impact to the mortar by feeding in compressed air by using a compressor, it has problems that impact sound is large, and work efficiency is poor. Particularly if the building to be worked is operating on 24 hours a day basis or in the case of schools, hospitals and the like which require silence, a work time slot is largely restricted due to the noise involved in the peeling work, a long time is required for completion of the peeling work, and a high labor cost is incurred by the peeling work, which is a problem.

In the case of these impact/vibration chipping machines, since the impact and vibration are transmitted also to the concrete framework, there is a concern that damage such as a crack is induced in the framework. Moreover, in an earthquake strengthening work, mortar with low strength should be completely removed, and only the concrete framework should be exposed, but it takes a long time to uniformly peel the mortar with those chipping machines performing chipping locally, and the mortar cannot be peeled with high accuracy, which is a problem. Furthermore, when these chipping machines are used, demolished mortar becomes small crushed pieces, a large quantity of fine particles and dusts are generated, and a work environment deteriorates, which is a problem.

In order to solve each of the above described problems, a mortar peeling method described below was proposed (see Patent Literature 1). In this mortar peeling method, for a mortar finished surface on which mortar is constructed with a predetermined thickness dimension on a surface of a concrete framework, a disk-shaped concrete cutter held on a rotating shaft is brought in, and while the rotating shaft is held orthogonally to the concrete framework surface, the concrete cutter is inserted into a boundary portion between the concrete framework and the mortar, and by moving the concrete cutter in parallel with the concrete framework surface, the mortar is cut and separated. This method has an effect that a noise is small and a mortar constructed on the surface of the concrete framework can be demolished in a short period of time.

CITATION LIST

Patent Literature

Patent Literature 1: Japanese Patent Laid-Open No. 2001-81975

SUMMARY OF INVENTION

Problem to be Solved by Invention

In the mortar peeling method disclosed in Patent Literature 1, since the concrete cutter is rotated and moved while the mortar is being cut, a cut surface of the mortar and a cutting edge of the cutter rub each other, and a large cutting sound is generated, a generated noise can be kept low as compared with the chipping work using the chipping machine, but it is difficult to bring the noise generated in the peeling work to an allowable small noise. Moreover, in this mortar peeling method, since wedge-shaped chip pieces are installed on a peripheral edge of the concrete cutter, and the mortar is split and taken by a rotating operation of the wedge-shaped chip pieces involved in the rotation of the concrete cutter, a peeling force of the wedge-shaped chip pieces cannot be concentrated easily on a peeling direction of the mortar, and a large peeling force cannot be transmitted to the mortar and thus, in the case of a firmly constructed mortar, the mortar cannot be peeled smoothly in some cases.

An object of the present invention is to provide a mortar peeling method which can keep a sound generated during a peeling work to an allowable quiet sound and can smoothly peel the mortar off the concrete framework. Another object of the present invention is to provide a mortar peeling method which can complete the peeling work efficiency in a short period of time without giving damage to a concrete framework.

Solution to Problem

A premise of the present invention in order to solve the above described problems is a mortar peeling method using a mortar peeling device for peeling a mortar constructed on a concrete framework.

A feature of the present invention on the above described premise is that the mortar peeling device is composed of a guide member separated away from an outer surface of mortar by a predetermined dimension and extending in one direction in parallel with the outer surface of the mortar, a jack having a piston rod capable of extending forward in one direction and located between the mortar and the guide member, a cutter located at a tip end portion of the piston rod and peeling the mortar off a concrete framework, jack connecting means for connecting the jack to the guide member at a predetermined spot, and first fixing means for fixing the guide member and the jack to a peeling spot of the mortar, and a mortar peeling method performs a mortar peeling process of peeling the mortar having a predetermined thickness off the concrete framework using the cutter by gradually advancing the cutter forward in one direction by gradually extending the piston rod of the jack forward in one direction.

As an example of the present invention, in the mortar peeling method, after the piston rod of the jack is extended forward in one direction, and a mortar is peeled, the piston rod is retreated rearward in one direction so as to complete a session of a mortar peeling process, and in the mortar peeling method, after the first mortar peeling process is executed, a jack movement process of releasing connection between the jack and the guide member and moving the jack forward in one direction is executed, and a subsequent mortar peeling process of connecting the jack to the guide member again after the jack is moved forward in one direction, gradually advancing the cutter forward in one direction by gradually extending the piston rod forward in one direction and peeling the mortar having a predetermined thickness off the concrete framework by using the cutter are executed.

As another example of the present invention, in the mortar peeling method, prior to execution of the first mortar peeling process, a guide groove creating process of creating two guide grooves extending linearly in one direction in the mortar along an outer edge of a peeling width of the mortar is executed, and a cutter installation portion creating process of chipping the mortar at a spot between the guide grooves and of drilling a cutter installation portion where the cutter is to be installed is executed.

As another example of the present invention, the mortar peeling device includes cutter connecting means for detachably connecting the cutter to the tip end portion of the piston rod, and in the mortar peeling method, prior to execution of the first mortar peeling process, a device preparation process of preparing the mortar peeling device by connecting the jack to the guide member at a predetermined spot through the jack connecting means while connecting the cutter to the tip end portion of the piston rod through the cutter connecting means is executed, and a device fixing process of fixing the mortar peeling device to the peeling spot of the mortar in the concrete framework through the first fixing means is executed.

As another example of the present invention, in the mortar peeling method, the movement process and the subsequent mortar peeling process are repeated, and after all the mortar as a peeling target is peeled off the concrete framework, a device removing process of removing the mortar peeling device off the peeling spot of the mortar is executed.

As another example of the present invention, the first fixing means is composed of a first anchor fixed to an anchor hole drilled in the mortar and a pressing plate detachably fixed to a free end portion of the first anchor exposed from the anchor hole and pressing the guide member toward the mortar, and in the mortar peeling method, the first fixing means is attached in the device fixing process, and the first fixing means is removed in the device removing process.

As another example of the present invention, the mortar peeling device includes second fixing means installed on a front end portion of the guide member and preventing movement of the guide member forward in one direction, and the second fixing means is composed of a first front endplate brought into contact with the front end portion of the guide member, a second front end plate connected to the first front end plate and brought into contact with the mortar, and a second anchor inserted into an anchor hole drilled in mortar and fixing the second front end plate to the mortar, and in the mortar peeling method, the second fixing means is attached in the device fixing process, and the second fixing means is removed in the device removing process.

As another example of the present invention, the mortar peeling device includes third fixing means installed on a rear end portion of the guide member and preventing movement rearward in one direction of the guide member, and the third fixing means is composed of a first rear end plate brought into contact with the rear end portion of the guide member, a second rear end plate connected to the first rear end plate and brought into contact with the mortar, and a third anchor inserted into an anchor hole drilled in the mortar and fixing the second rear end plate to the mortar, and in the mortar peeling method, the third fixing means is attached in the device fixing process, and the third fixing means is removed in the device removing process.

As another example of the present invention, the cutter is composed of a cutting edge located at a predetermined depth from an outer surface of the mortar and a mounting base connected to the cutting edge, and in the mortar peeling method, a top portion of the mounting base is slidably brought into contact with the guide member and prevents movement of the cutter in a direction away from the outer surface of the mortar.

As another example of the present invention, in the mortar peeling method, by adjusting a dimension in a direction crossing one direction of a cutting edge, a peeling width of the mortar peeled off the concrete framework can be adjusted.

As another example of the present invention, in the mortar peeling method, a sound pressure level generated in peeling of the mortar is within a range of 50 to 80 dB.

As another example of the present invention, the jack is a hydraulic jack connected to an electric hydraulic jack.

Advantageous Effects of Invention

According to the mortar peeling method according to the present invention, since a mortar peeling process of gradually advancing a cutter forward in one direction by gradually extending a piston rod of a jack forward in one direction and of peeling mortar with a predetermined thickness off a concrete framework by using the cutter is executed, a large cutting sound caused by rubbing between a cutting surface of the mortar and the cutter is not generated, and a sound generated during a peeling work can be kept to an allowable quiet sound while the mortar can be peeled of the concrete framework. Regarding the mortar peeling method, a force (torque) is transmitted linearly from the piston rod of the jack to the cutter, and a linear force of the cutter can be concentrated on a peeling spot of the mortar, whereby a large peeling force acts on the mortar, and thus, even a firmly constructed mortar can be peeled smoothly and reliably. Since the mortar peeling method can smoothly peel the mortar off the concrete framework by using the jack and the cutter, not only that a peeling work can be completed efficiently in a short period of time but also the mortar can be peeled over a wide range once off the concrete framework, and the peeling work can be performed inexpensively. In the mortar peeling method, since unnecessary vibration is not transmitted to the concrete framework during the mortar peeling work, the mortar can be peeled off the concrete framework without damaging the concrete framework. Moreover, the mortar can be peeled off the concrete framework uniformly in a short period of time with high accuracy, generation of fine particles and dusts during the peeling work is less, and the peeling work can be performed in a favorable environment.

In the mortar peeling method in which, after the first mortar peeling process is executed in which the piston rod of the jack is extended forward in one direction, and the mortar is peeled, the piston rod is retreated rearward in one direction so as to complete a session of the mortar peeling process, and after the first mortar peeling process is executed, the movement process of releasing connection between the jack and the guide member and moving the jack forward in one direction is executed, and the subsequent mortar peeling process of connecting the jack to the guide member again after the jack is moved forward in one direction, gradually advancing the cutter forward in one direction by gradually extending the piston rod forward in one direction and peeling the mortar off the concrete framework is executed, after peeling for a portion of the extended dimension of the piston rod is performed, peeling for the portion of the extended dimension of the piston rod can be further performed by moving the jack forward in one direction and connecting the jack to the guide member again, and thus, the mortar peeling process can be executed repeatedly, and even if a peeling length of the mortar is large, all the mortar as the peeling target can be peeled off the concrete framework. Since in the mortar peeling method, the jack is moved forward in one direction and the jack is only connected to the guide member as a work in which the peeling process is repeatedly performed and other works are not involved, the peeling work of the mortar can be completed without labor in a short period of time and with efficiency.

In the mortar peeling method in which, prior to execution of the first mortar peeling process, the guide groove creating process of creating the two guide grooves extending linearly in one direction in the mortar along the outer edge of the peeling width thereof is executed, and the cutter installation portion creating process of chipping the mortar at the spot between the guide grooves and of drilling the cutter installation portion where the cutter is to be installed is executed, since the guide grooves are created on the outer edge of the peeling width of the mortar by the guide groove creating process, and the mortar peeling process is executed by installing the peeling device on inner sides of those guide grooves, only the mortar present in the inner side of the guide grooves can be peeled, the mortar can be partially peeled off the concrete framework, and only the mortar requiring peeling in the entire mortar can be peeled. In the mortar peeling method, since the cutter installation portion with the predetermined depth where the cutter is to be installed is drilled at the spot between the guide grooves by the cutter installation portion creating process, by installing the cutter in the cutter installation portion with the predetermined width and peeling the mortar, the mortar with the predetermined thickness can be reliably peeled off the concrete framework.

In the mortar peeling method in which, prior to execution of the first mortar peeling process, the device preparation process of preparing the mortar peeling device by connecting the jack to the guide member at the predetermined spot through the jack connecting means while connecting the cutter to the tip end portion of the piston rod through the cutter connecting means is executed, and the device fixing process of fixing the mortar peeling device to the peeling spot of the mortar in the concrete framework through the fixing means is executed, the mortar peeling device composed of the cutter, the jack, and the guide member is prepared in advance by the device preparation process, and the mortar peeling device is fixed to the peeling spot of the mortar by the device fixing process and thus, the mortar peeling work can be performed only by fixing the mortar peeling device already prepared to the peeling spot, a construction period required for mortar peeling can be drastically reduced, and the peeling work can be performed inexpensively. In the mortar peeling method, mortar peeling can be performed in any other spots in the concrete framework such as a ceiling, a wall, a floor slab and the like.

In the mortar peeling method in which the movement process and the subsequent mortar peeling process are repeated, and after all the mortar as the peeling target is peeled off the concrete framework, the device removing process of removing the mortar peeling device off the peeling spot of the mortar is executed, after all the mortar as the peeling target is peeled, by removing the peeling device from the concrete framework by the device removing process, only the concrete framework from which the mortar has been peeled can be left, and a renovation work of the mortar, an earthquake strengthening work by increasing a thickness of the mortar and the like after that can be smoothly performed. In the mortar peeling method, the removed mortar device can be used for other spots of the concrete framework and peeling of the mortar in other concrete frameworks, and not only that the mortar can be peeled over a wide range once off the concrete framework but also the mortar peeling can be performed in any other spots in the concrete framework such as a ceiling, a wall, a floor slab and the like.

In the mortar peeling method in which the first fixing means is composed of the first anchor and the pressing plate detachably fixed to the free end portion of the first anchor and pressing the guide member toward the mortar, and the first fixing means is attached in the device fixing process, and the first fixing means is removed in the device removing process, during the work of moving the cutter (piston rod) forward in one direction, a force for moving the guide member in a direction away from the outer surface of a cement cured article acts on the guide member from the cutter, but since the movement of the guide member in the direction away from the outer surface of the mortar is prevented by the first anchor and the pressing plate, the cutter can be made to reliably bite into the mortar, and the mortar with the predetermined thickness can be reliably peeled off the concrete framework. In the mortar peeling method, by removing the first fixing means in the device removing process after all the mortar as the peeling target is peeled, only the concrete framework from which the mortar has been peeled can be left, a renovation work of the mortar, an earthquake strengthening work by increasing a thickness of the mortar after that can be smoothly performed.

In the mortar peeling method in which the second fixing means preventing movement of the guide member forward in one direction is attached in the device fixing process, the second fixing means is attached in the device fixing process, and the second fixing means is removed in the device removing process, during the work of moving the cutter (piston rod) rearward in one direction, a force for moving the guide member forward in the one direction acts on the guide member from the cutter, but since the movement of the guide member forward in one direction is prevented by the second fixing means attached in the device fixing process, shifting of the guide member or the cutter with respect to the concrete framework during the peeling work can be prevented, the cutter can be smoothly retreated rearward in one direction after the mortar peeling process is executed, and the subsequent peeling process can be smoothly executed. In the mortar peeling method, after all the mortar as the peeling target is peeled, by removing the second fixing means in the device removing process, only the concrete framework from which the mortar has been removed can be left, and a renovation work of the mortar, an earthquake strengthening work by increasing a thickness of the mortar and the like after that can be smoothly performed.

In the mortar peeling method in which the third fixing means preventing movement of the guide member rearward in one direction is attached in the device fixing process, and the third fixing means is removed in the device removing process, during the peeling work of moving the cutter (piston rod) forward in one direction, a force for moving the guide member rearward in one direction acts on the guide member from the cutter, but since the movement of the guide member rearward in one direction is prevented by the third fixing means attached in the device fixing process, shifting of the guide member or the cutter with respect to the concrete framework during the peeling work can be prevented, the cutter can be made to reliably bite into the mortar, and the mortar with the predetermined thickness can be reliably peeled off the concrete framework. In the mortar peeling method, after all the mortar as the peeling target is peeled, by removing the third fixing means in the device removing process, only the concrete framework from which the mortar has been peeled can be left, and a renovation work of the mortar, an earthquake strengthening work by increasing a thickness of the mortar after that can be smoothly performed.

In the mortar peeling method, the cutter is composed of the cutting edge located at the predetermined depth from the outer surface of the mortar and the mounting base connected to the cutting edge, and the top portion of the mounting base is slidably brought into contact with the guide member and prevents movement of the cutter in a direction away from the outer surface of the mortar, during the peeling work of moving the cutter (piston rod) forward in one direction, a force for moving the cutter in the direction away from the outer surface of the mortar acts on the cutter, but since the movement of the cutter in the direction away from the outer surface of the mortar is prevented by the guide member fixed by the first fixing means, the cutting edge of the cutter can be made to reliably bite into the mortar, and the mortar with the predetermined thickness can be reliably peeled off the concrete framework.

In the mortar peeling method, by adjusting the dimension in the direction crossing one direction of the cutting edge, the peeling width of the mortar peeled off the concrete framework can be adjusted, by reducing the dimension of the cutting edge of the cutter, the peeling dimension of the mortar to be peeled off the concrete framework can be reduced, and by increasing the dimension of the cutting edge of the cutter, the peeling dimension of the mortar to be peeled off the concrete framework can be increased, and thus, the peeling dimension (peeling area) of the mortar to be peeled off the concrete framework can be handled, and the mortar with a desired peeling dimension can be peeled off the concrete framework.

In the mortar peeling method in which the sound pressure level generated in peeling of mortar is within a range of 50 to 80 dB, since the sound pressure level generated during the peeling is within the above described range, the mortar can be peeled off the concrete framework without generating a large noise, and the sound generated during the peeling work can be kept to an allowable quiet sound. In the mortar peeling method, the mortar peeling work can be performed for the concrete framework in a place requiring a silent environment, a time slot of the peeling work is not limited, and peeling of the mortar can be completed in a short construction period.

In the mortar peeling method in which the jack is a hydraulic jack connected to an electric hydraulic jack, by using a jack operated by a hydraulic pressure as the jack, a large force (torque) can be transmitted from the piston rod to the cutter, and a large peeling force acts on the mortar, and thus, the mortar can be peeled off the concrete framework smoothly and reliably.

MODE FOR CARRYING OUT THE INVENTION

Figure 2:
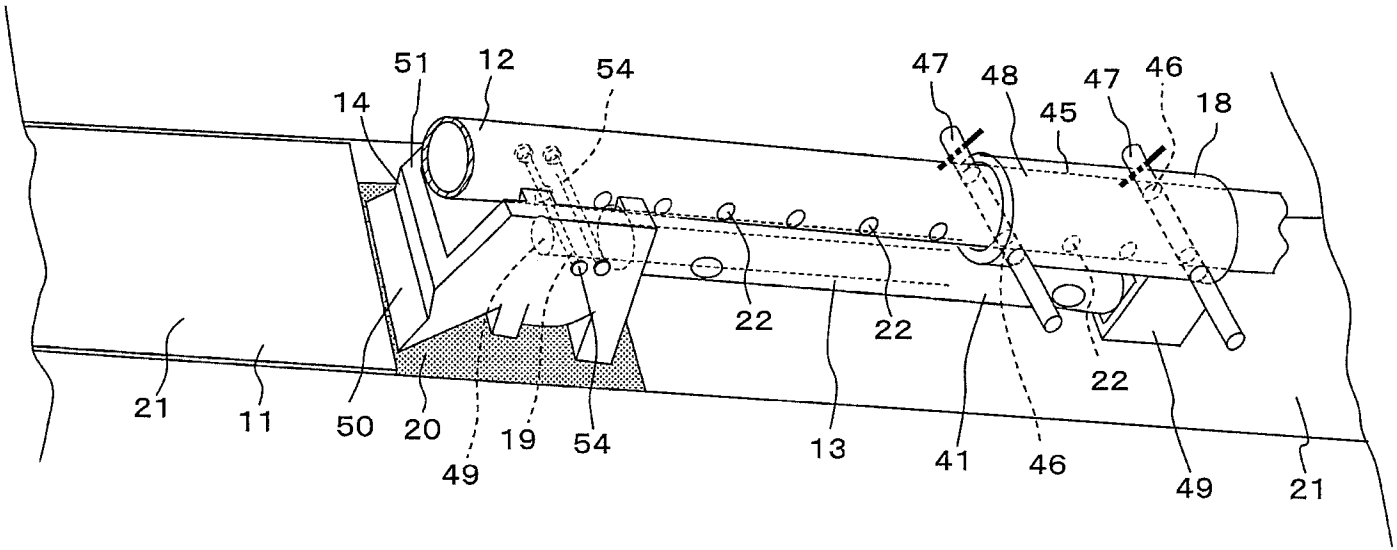
FIG. 2 is a perspective view of the mortar peeling device.
Figure 3:
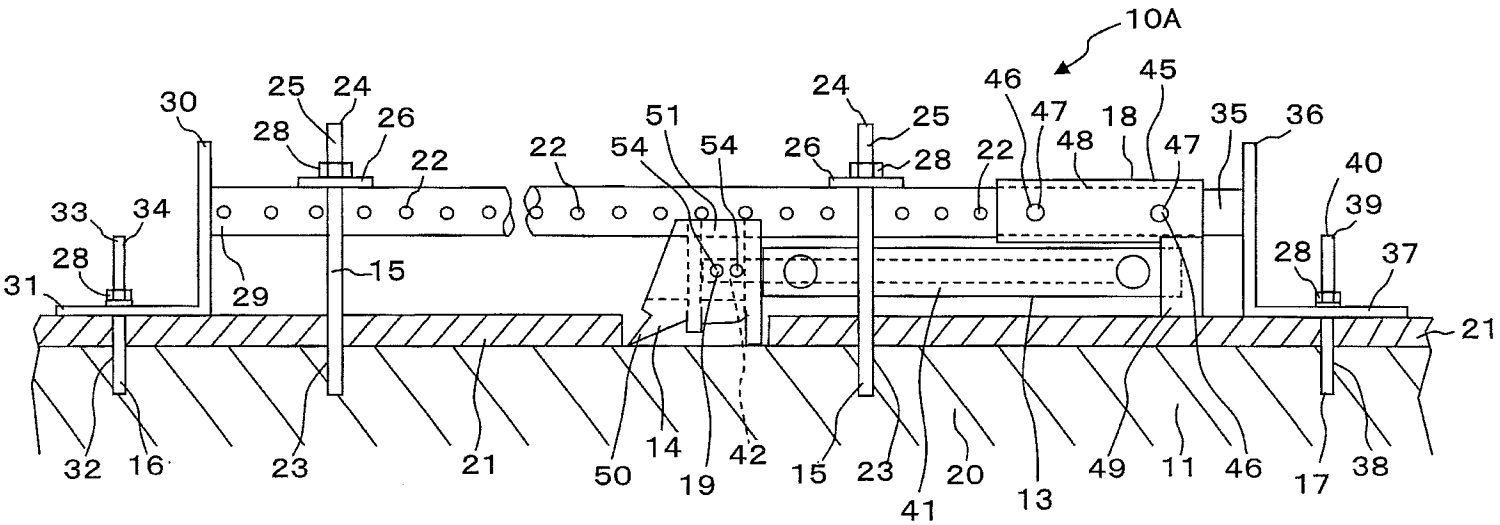
FIG. 3 is a side view of the mortar peeling device.
Figure 4:
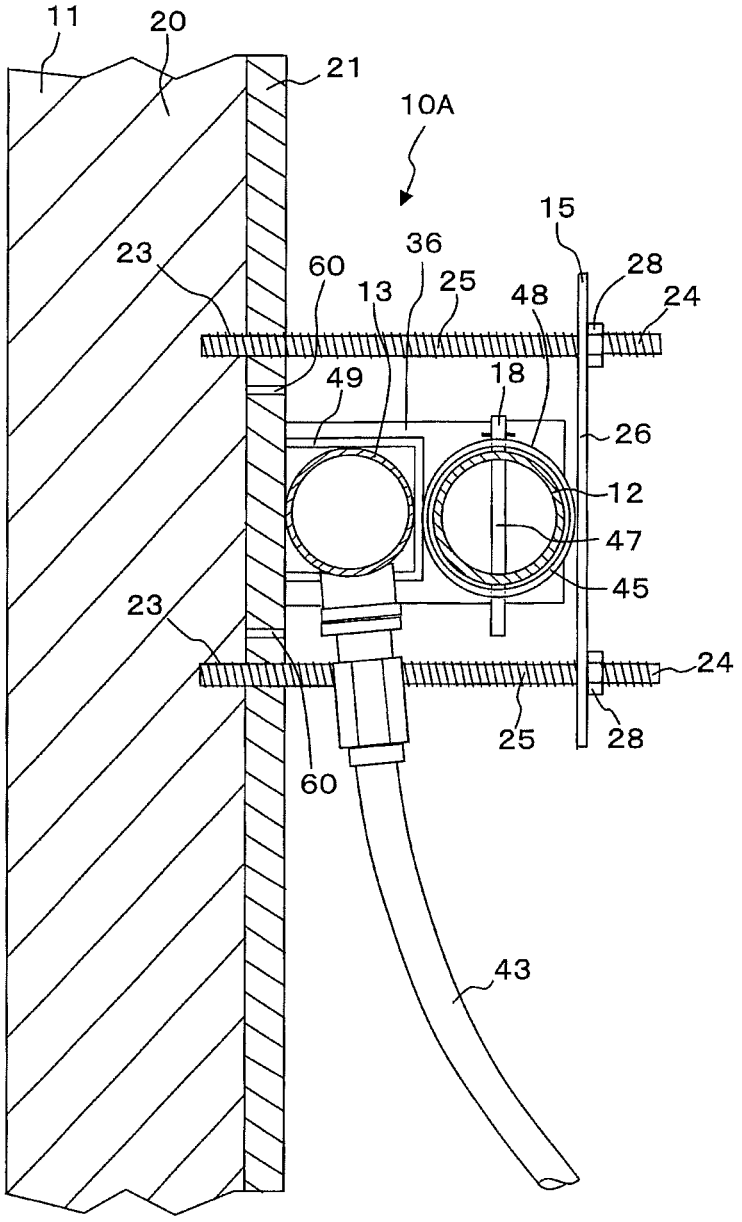
FIG. 4 is a sectional view on an arrow of L-L line in FIG. 1.
Figure 5:
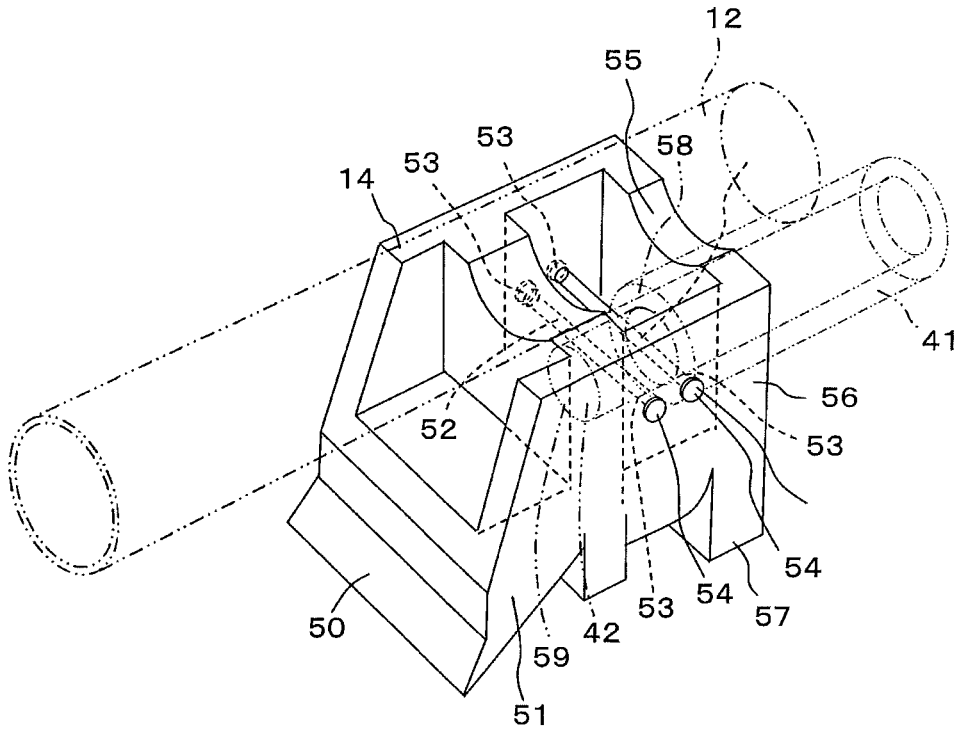
FIG. 5 is an enlarged perspective view of a cutter.

By referring to the attached drawings such as FIG. 1 which is a top view of a mortar peeling device 10A illustrated as an example and the like, details of a mortar peeling method according to the present invention will be described as follows. FIG. 2 is a perspective view of the mortar peeling device 10A, and FIG. 3 is a side view of the mortar peeling device 10A. FIG. 4 is a sectional view on an arrow of L-L line in FIG. 1, and FIG. 5 is an enlarged perspective view of a cutter 14.

Figure 1:
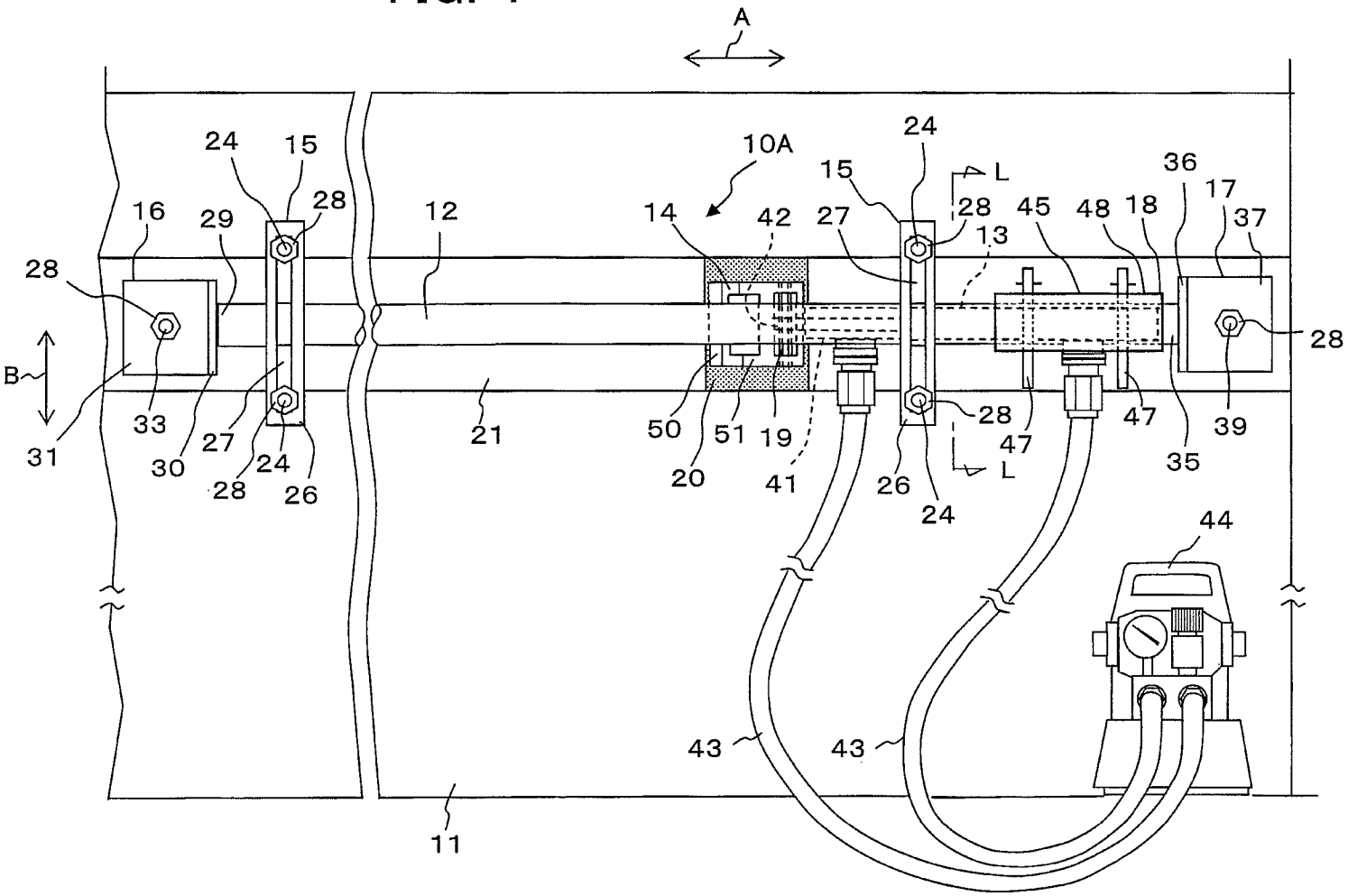
FIG. 1 is a top view of a mortar peeling device illustrated as an example.

In FIG. 1, one direction (longitudinal direction in a building illustrated in FIG. 1) is indicated by an arrow A, while a width direction (vertical direction in the building illustrated in FIG. 1) crossing the one direction is indicated by an arrow B. In FIGS. 1 to 4, a state in which the mortar peeling device 10A is installed on an upper part on an inner wall 11 of the building is illustrated. In FIG. 2, front and rear end portions 29 and 35 of a guide member 12 and first fixing means 15 are not shown, and in FIGS. 2 and 3, a hydraulic tube 43 is not shown. In FIG. 5, the guide member 12 and the piston rod 42 are indicated by one-dot chain lines.

In the mortar peeling method, mortar 21 having a predetermined thickness constructed on a concrete framework 20 of the building is peeled off the concrete framework 20 by using the mortar peeling device 10A or a mortar peeling device 10B which will be described later. In the mortar peeling method, each of a device preparation process, a guide groove creating process, a cutter installation portion creating process, an anchor fixing process, a device fixing process, a first peeling process (first mortar peeling process), a jack first movement process (jack movement process), a second peeling process (subsequent mortar peeling process), a jack second movement process (jack movement process), . . . a jack n-th movement process (jack movement process), a n-th peeling process, (subsequent mortar peeling process), a device removing process, and an anchor cutting process is executed. The building includes any type of buildings such as an office building, an intelligent building, an apartment house, a hospital, a school, a nuclear power plant, an indoor parking lot, a basement parking lot and the like and also any type of structures such as a dam, a bridge, a road, an outer wall and the like.

Hereinafter, the mortar peeling method will be described by using a case in which the mortar peeling device 10A is installed on the inner wall 11 of a reinforced concrete building as an example. The mortar peeling device 10A can be used not only for the inner wall 11 of the building but also can be installed on a floor slab, a cantilever slab, a ceiling slab, a column, and a beam of a building and used for peeling of the mortar 21 constructed on them. In those figures, the mortar peeling device 10A is installed in the longitudinal direction in the inner wall 11 of the building (concrete framework), but an installation direction (direction in which the guide member extends) of the device 10A in the inner wall 11 of the building is not particularly limited, and as long as a space for installing the device 10A can be ensured, the device 10A can be installed in any direction. The mortar peeling device 10A is provided with the guide member 12 extending in one direction, a hydraulic jack 13, the cutter 14, first to third fixing means 15 to 17, and first to second connecting means 18 and 19.

The guide member 12 is a hollow cylindrical metal pipe (an iron pipe, an aluminum pipe, a stainless pipe and the like) extending in one direction, and its sectional shape is molded circularly. The guide member 12 may be molded not only having a circular shape but also having a square sectional shape. The guide member 12 is separated away from the outer surface of the mortar 21 by a predetermined dimension and is installed on the inner wall 11 of the building so as to be in parallel with the outer surface of the mortar 21. It is only necessary that the guide member 12 has a length dimension of a peeling length or more of the mortar 21 to be peeled off, and the length dimension is not particularly limited. In the guide member 12, a plurality of through holes 22 (first connecting means 18) are drilled therein by penetrating and being juxtaposed at equal intervals (predetermined intervals) in one direction. The guide member 12 is installed and fixed to the inner wall 11 by the first to third fixing means 15 to 17.

The first fixing means 15 are juxtaposed in one direction away from each other by a predetermined dimension in one direction and prevent movement of the guide member 12 in a direction away from the outer surface of the mortar 21. In FIG. 1, two units of the first fixing means 15 are illustrated, but the number of the fixing means 15 is not particularly limited and three or more units of the fixing means 15 may be installed in accordance with the length dimension of the guide member 12. The first fixing means 15 is composed of a first anchor 24 inserted and fixed into an anchor hole 23 drilled in the inner wall 11 (the concrete framework 20 and the mortar 21) and a pressing plate 26 detachably fixed to a free end portion 25 of the anchor 24 exposed from the anchor hole 23.

The first anchors 24 are arranged on both sides of the member 12 in a state in which the two anchors sandwich the guide member 12. As the first anchor 24, though not illustrated in detail, any one of a capsule type anchor, a resin injection anchor, a screw anchor, a cut anchor can be used. The first anchor 24 is made of steel but other than the steel, it may be made of metal such as stainless, an aluminum alloy, a titanium alloy and the like or a synthetic resin.

The pressing plate 26 is a metal plate elongated in a width direction, and an opening 27 extending in the width direction is formed at a center part thereof. In the opening 27 of the pressing plate 26, the free end portion 25 of the first anchor 24 is removably inserted. A male screw formed on the free end portion 25 of the first anchor 24 has a hexagon head nut 28 screwed. The pressing plate 26 is pressed by the nut 28 toward the outer surface of the mortar 21, and the pressing plate 26 is fixed by the first anchor 24 and the nut 28 and also, the guide member 12 is pressed by the pressing plate 26 toward the outer surface of the mortar 21.

The second fixing means 16 is installed on the front end portion 29 of the guide member 12. The second fixing means 16 is composed of a first front end plate 30 brought into contact with the front end portion 29 of the guide member 12, a second front end plate 31 connected to the first front end plate 30 and brought into contact with the inner wall 11 (mortar 21), and a second anchor 33 inserted into an anchor hole 32 drilled in the inner wall 11 (the concrete framework 20 and the mortar 21). The first front endplate 30 and the second front endplate 31 are made of metal such as iron, aluminum, stainless and the like, and the plates 30 and 31 are integrated so as to form an L-shaped stopper.

At a center part of the second front endplate 31, a through hole penetrating the plate 31 is formed. Into the through hole, a free end portion 34 of the second anchor 33 exposed from the anchor hole 32 is removably inserted. With a male screw formed on the free end portion 34 of the second anchor 33 exposed from the through hole, a hexagon head nut 28 is screwed. As the second anchor 33, similarly to the first anchor 24, any one of a capsule type anchor, a resin injection anchor, a screw anchor, and a cut anchor can be used. The first and second front end plates 30 and 31 are fixed to the inner wall 11 (mortar 21) by the second anchor 33 and the hexagon head nut 28, and movement of the guide member 12 forward in one direction is prevented by the second fixing means 16 (first front end plate 30).

The third fixing means 17 is installed on a rear end portion 35 of the guide member 12. The third fixing means 17 is composed of a first rear end plate 36 brought into contact with the rear end portion 35 of the guide member 12, a second rear endplate 37 connected to the first rear endplate 36 and brought into contact with the inner wall 11 (mortar 21), and a third anchor 39 inserted into an anchor hole 38 drilled in the inner wall 11 (the concrete framework 20 and the mortar 21). The first rear end plate 36 and the second rear end plate 37 are made of metal such as iron, aluminum, stainless and the like, and the plates 36 and 37 are integrated so as to form an L-shaped stopper.

At a center part of the second rear end plate 37, a through hole penetrating the plate 38 is formed. Into the through hole, a free end portion 40 of the third anchor 39 exposed from the anchor hole 38 is removably inserted. With a male screw formed on the free end portion 40 of the third anchor 39 exposed from the through hole, the hexagon head nut 28 is screwed. As the third anchor 39, similarly to the first anchor 24, any one of a capsule type anchor, a resin injection anchor, a screw anchor, and a cut anchor can be used. The first and second rear end plates 36 and 37 are fixed to the inner wall 11 (mortar 21) by the third anchor 39 and the hexagon head nut 28, and movement of the guide member 12 rearward in one direction is prevented by the third fixing means 17 (first rear end plate 36).

Though not shown, if the front end portion 29 or the rear end portion 35 of the guide member 12 is brought into contact with the outer surface of the column or the beam of the building, the column or the beam is used as the second fixing means 16 or the third fixing means 17, and movement forward in one direction or rearward in one direction of the member 12 can be prevented by the column or the beam, installation of the second fixing means 16 (the first front end plate 30, the second front end plate 31, the second anchor 33) or the third fixing means 17 (the first rear end plate 36, the second rear end plate 37, the third anchor 39) can be omitted.

The hydraulic jack 13 is located between the guide member 12 and the mortar 21. In FIG. 1, the hydraulic jack 13 is detachably connected to the rear end portion of the guide member 12 through the first connecting means 18. The hydraulic jack 13 has a cylindrical hydraulic cylinder 41 and a columnar piston rod 42. On a peripheral wall in a front end portion and an intermediate portion of the hydraulic cylinder 41, a hydraulic tube 43 is attached. The hydraulic tube 43 is connected to an electric hydraulic pump 44. In the hydraulic jack 13, the piston rod 42 is extended (advanced) forward in one direction and also retreated rearward in one direction by a hydraulic oil (hydraulic working oil) fed out of the hydraulic pump 44. As the jack, other than the hydraulic jack 13, a water-pressure jack can be also used.

The first connecting means 18 is composed of a slider 45 connected to a rear end portion of the hydraulic jack 13 (hydraulic cylinder 41), the through hole 22 drilled in the guide member 12, a through hole 46 drilled in the slider 45 (a cylinder member 48 which will be described later), and a connecting pin 47 removably inserted into each of the through holes 22 and 46. The slider 45 is made of metal such as iron, aluminum, stainless and the like. The slider 45 is formed of the cylindrical cylinder member 48 detachably fitted with the outer peripheral surface of the guide member 12 and a base 49 connected to a rear end portion of the cylinder member 48. The cylinder member 48 and the base 49 are fixed by welding and integrated. The cylinder member 48 is slidable forward in one direction and rearward in one direction on the outer peripheral surface of the guide member 12.

The base 49 is molded having a prism shape and has both side walls and a bottom wall. Inside the base 49, the rear end portion of the hydraulic cylinder 41 is accommodated, and the rear end portion of the cylinder 41 is fixed to the base 49 by welding. The bottom wall (bottom surface) of the base 49 is brought into contact with the outer surface of the inner wall 11 (mortar 21). The through holes 46 are formed on a peripheral surface of the cylinder member 48, penetrate in a width direction and are juxtaposed in one direction away from each other by a predetermined dimension. The connecting pin 47 is made of metal such as iron, aluminum, stainless and the like.

The cylinder member 48 is fitted with the outer peripheral surface of the guide member 12, and the through hole 22 formed in the guide member 12 is matched with the through hole 46 formed in the cylinder member 48 and then, the connecting pin 47 is inserted through the through holes 22 and 46 so that the hydraulic jack 13 can be connected to the guide member 12. On the contrary, by pulling the connecting pin 47 out of the through holes 22 and 46, the connection between the hydraulic jack 13 and the guide member 12 can be released. After the connection between the hydraulic jack 13 and the guide member 12 is released, by sliding the slider 45 forward in one direction or rearward in one direction and by inserting the connecting pin 47 into those through holes 22 and 46, the jack 13 can be installed at a predetermined spot of the guide member 12.

The cutter 14 is made of steel, and as illustrated in FIG. 5, it is made of a cutting edge 50 for peeling off the mortar 21 and a mounting base 51 connecting to the cutting edge 50. The cutter 14 is detachably connected to the tip end portion of the piston rod 42 through the second connecting means 19. The second connecting means 19 is composed of two through holes 52 drilled in the tip end portion of the piston rod 42, two through holes 53 drilled in the mounting base 51 of the cutter 14, and a connecting pin 54 to be removably inserted into those through holes 52 and 53.

The connecting pin 54 is made of metal such as iron, aluminum, stainless and the like. The cutting edge 50 is located at a predetermined depth from the outer surface of the mortar 21 and is brought into contact with the outer surface of the concrete framework 20. In the cutter 14 in FIG. 5, the cutting edge 50 and the mounting base 51 are integrated, but a blade having the cutting edge 50 and the mounting base 51 may be separable so that the blade can be detachably fixed to the mounting base 51.

The mounting base 51 has a top portion 55, a bottom portion 57, and an intermediate portion 56 located between the top and bottom portions 55 and 57. The top portion 55 of the mounting base 51 is molded having a semicircular shape which is substantially the same as the shape of the outer peripheral surface of the guide member 12 and is slidably brought into contact with the outer peripheral surface of the guide member 12. When the top portion 55 of the mounting base 51 is brought into contact with the outer peripheral surface of the guide member 12, movement of the cutter 14 (cutting edge 50) in a direction away from the outer surface of the concrete framework 20 is prevented.

In the intermediate portion 56 of the mounting base 51, an insertion hole 58 into which the tip end portion of the piston rod 42 is removably inserted and a contact surface 59 with which the tip end of the rod 42 is brought into contact are formed. The insertion hole 58 penetrates in one direction. The through hole 52 forming the second connecting means 19 is formed in the intermediate portion 56 of the mounting base 51 and penetrates in a width direction. The bottom portion 57 of the mounting base 51 is brought into contact with the outer surface of the mortar 21.

When the tip end portion of the piston rod 42 is inserted into the through hole 58 of the mounting base 51, and the tip end of the rod 42 is brought into contact with the contact surface 59 of the mounting base 51, the through hole 52 drilled in the tip end portion of the rod 42 matches the through hole 53 drilled in the mounting base 51. In a state in which the through holes 52 and 53 are matched with each other, the cutter 14 can be connected to the tip end portion of the piston rod 42 by inserting the connecting pin 54 into those through holes 52 and 53.

On the other hand, by pulling the connecting pin 54 out of the through holes 52 and 53, the connection between the cutter 14 and the piston rod 42 can be released. When the piston rod 42 of the hydraulic jack 13 extends forward in one direction, the cutter 14 (cutting edge 50) moves forward in one direction with that, while when the piston rod 42 retreats rearward in one direction, the cutter 14 moves rearward in one direction with that.

Figure 6:
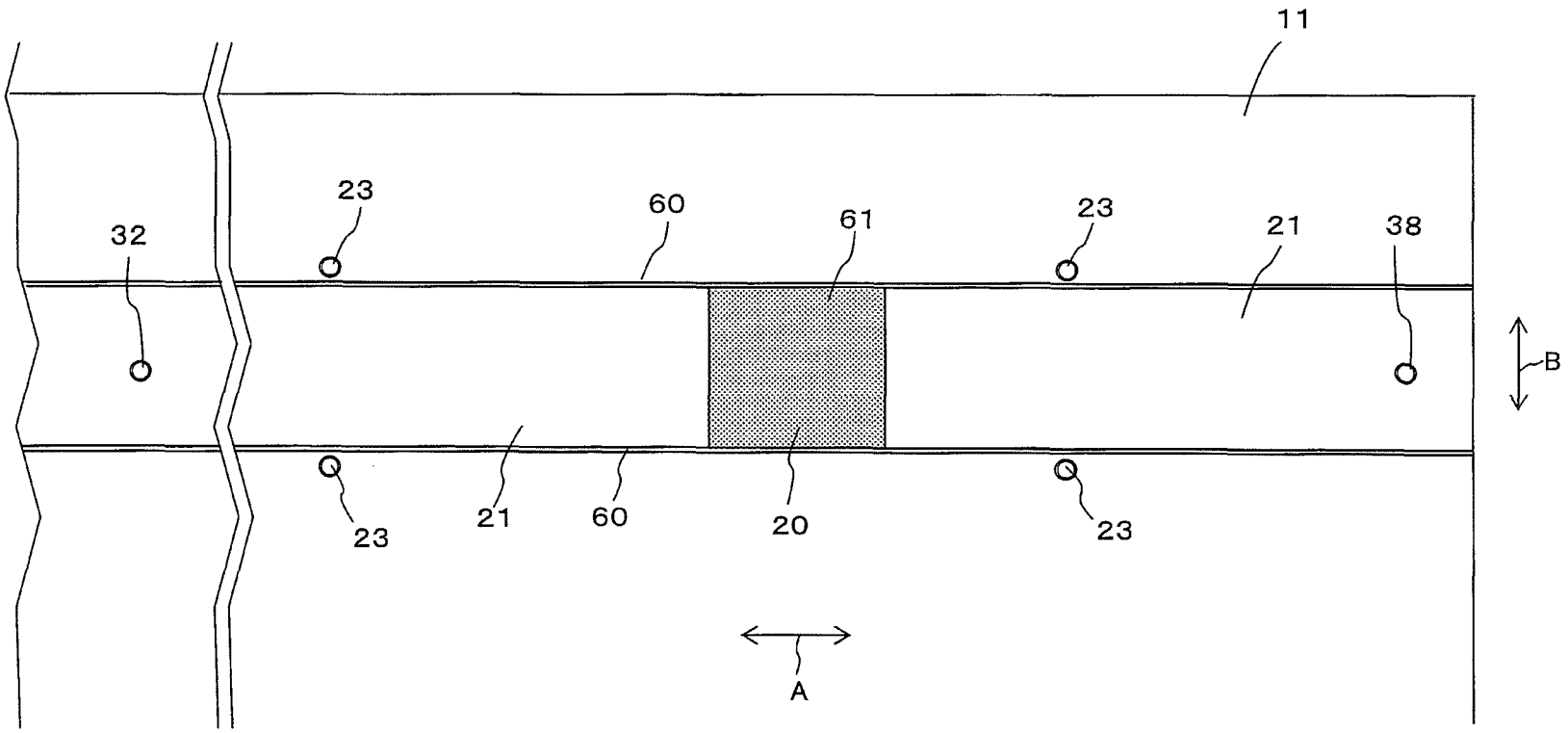
FIG. 6 is a diagram illustrating an example of a mortar peeling method of mortar using the mortar peeling device.
Figure 7:
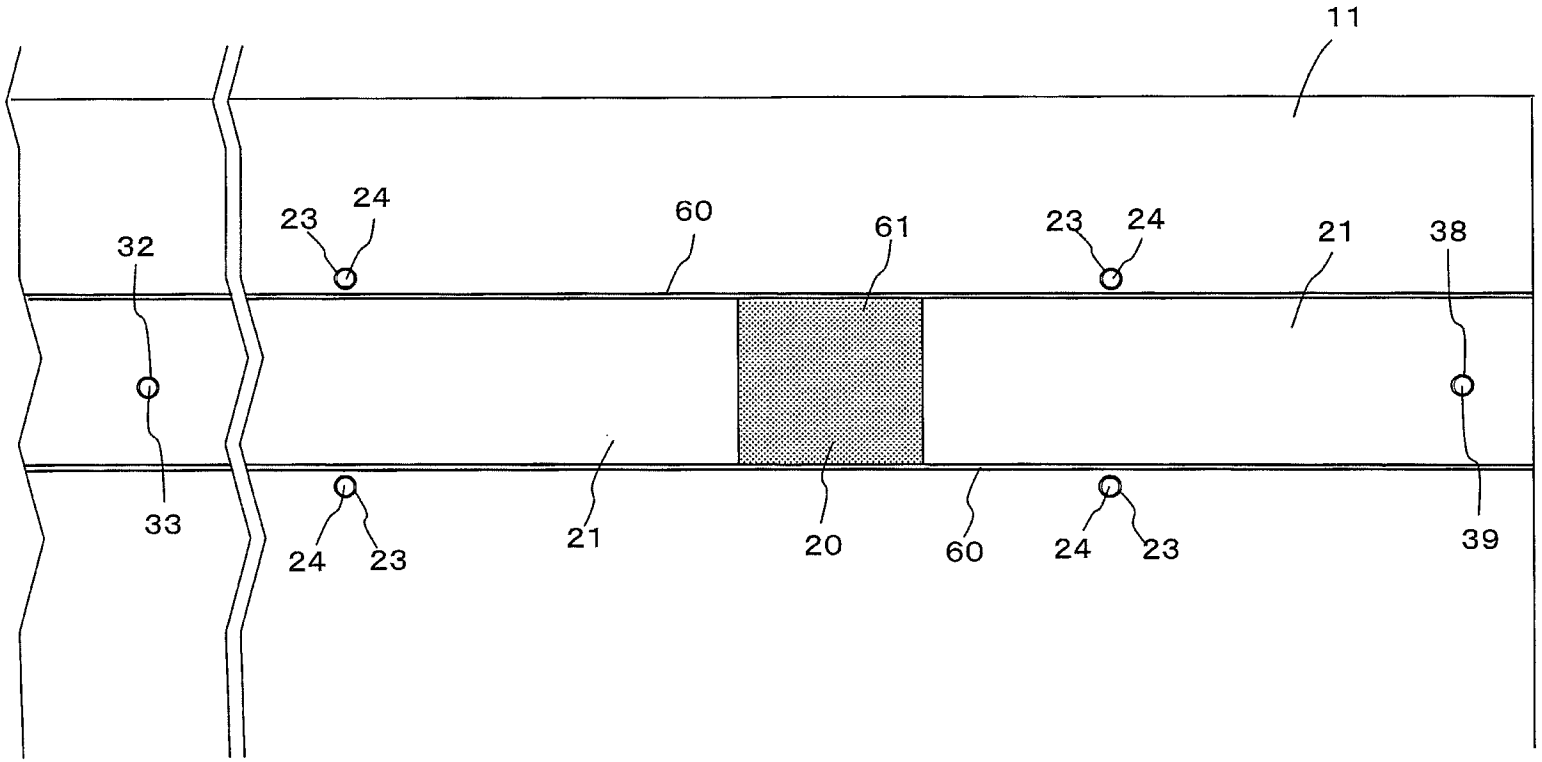
FIG. 7 is a diagram illustrating the mortar peeling method continued from FIG. 6.

FIG. 6 is a diagram illustrating an example of a mortar peeling method using the mortar peeling device 10A, and FIG. 7 is a diagram illustrating the mortar peeling method continued from FIG. 6. In FIG. 6, one direction (a longitudinal direction in a building illustrated in FIG. 6) is indicated by an arrow A, and a width direction (vertical direction in the building illustrated in FIG. 6) crossing the one direction is indicated by an arrow B.

The mortar peeling method will be described on the basis of those figures as follows. First, as prior preparation for executing these processes, a peeling spot on the inner wall 11 where the mortar 21 is to be peeled is determined, a peeling width dimension of the mortar 21 (a dimension in a width direction of the mortar 21 to be peeled) is determined, a peeling length dimension of the mortar 21 (a dimension in one direction of the mortar 21 to be peeled) is determined, and a peeling depth dimension of the mortar 21 (a depth dimension toward the concrete framework 20 of the mortar 21 to be peeled) is determined.

Depending on the peeling width dimension of the mortar 21, a width dimension of the cutting edge 50 of the cutter 14 is determined. Specifically, if the peeling width dimension of the mortar 21 is large, the cutter 14 having the cutting edge 50 with a large width dimension is used, while if the peeling width dimension of the mortar 21 is small, the cutter 14 having the cutting edge 50 with a small width dimension is used. In the mortar peeling method, the peeling width dimension of the mortar 21 to be peeled off the concrete framework 20 (peeling dimension in a direction crossing the one direction) can be adjusted by adjusting the width dimension of the cutting edge 50 (dimension in the direction crossing the one direction).

After those dimensions are determined, the tip end portion of the piston rod 42 is inserted into the through hole 58 of the mounting base 51, the tip end of the rod 42 is brought into contact with the contact surface 59 of the mounting base 51, and in the state in which the through holes 52 and 53 are matched with each other, the connecting pin 54 is inserted into those through holes 52 and 53, and the cutter 14 is connected to the tip end portion of the rod 42 by the second connecting means 19. In the mortar peeling method, the piston rod 42 and the cutter 14 can be easily connected through the connecting pin 54 and moreover, the connection between the rod 42 and the cutter 14 can be easily released by pulling out the connecting pin 54, and the cutter 14 (cutting edge 50) damaged by a long-term use can be rapidly replaced.

Subsequently, the cylinder member 48 of the slider 45 is fitted with the outer peripheral surface of the guide member 12, and in the state in which the through holes 22 and 46 are matched with each other, the connecting pin 47 is inserted into those through holes 22 and 46, and the hydraulic jack 13 is connected to the guide member 12 by the first connecting means 18 (device preparation process). In the mortar peeling method, the hydraulic jack 13 and the guide member 12 can be easily connected through the slider 45 and the connecting pin 47, and the connection between the jack 13 and the guide member 12 can be easily released by pulling out the connecting pin 47.

In parallel with the device preparation process or after the mortar peeling device 10A is prepared in the device preparation process, as illustrated in FIG. 6, two guide grooves 60 extending linearly in one direction along an outer edge of a peeling width of the mortar 21 are formed (guide groove creating process). Specifically, by using a concrete cutter, the mortar 21 is cut along the outer edge of the peeling width so as to create the guide grooves 60. A groove depth of each of the guide grooves 60 is the same as the peeling depth of the mortar 21.

The guide grooves 60 are made for peeling only the mortar 21 constructed on the inner side of those guide grooves 60 and for preventing peeling of the mortar 21 constructed outside of the guide grooves 60. If the mortar 21 is to be peeled off the whole region of the inner wall 11, the creation of the guide grooves 60 can be omitted. After the guide grooves 60 are made, the mortar 21 at a spot between the guide grooves 60 is peeled, and a cutter installation portion 61 in which the cutter 14 is fitted is drilled at the spot (cutter installation portion creating process). Specifically, by using a core drill, the cutter installation portion 61 having the substantially same length and width as the length dimension and the width dimension of the cutter 14 is made.

After the guide grooves 60 are made and the cutter installation portion 61 is made, the cylindrical anchor holes 23, 32, and 38 are drilled at spots where the first to third fixing members 15 to 17 are to be installed, and the first to third anchors 24, 33, and 39 are installed and fixed in those anchor holes 23, 32, and 38 (anchor fixing process). Those anchor holes 23, 32, and 38 are drilled by a vibration drill (electric tool) (not shown). The anchor holes 23, 32, and 38 penetrate mortar 21 (mortar layer) and reach the concrete framework 20. As long as the first to third anchors 24, 33, and 39 can be firmly fixed, the depth dimensions of the anchor holes 23, 32, and 38 are not particularly limited.

After the first to third anchors 24, 33, and 39 are fixed to each of the anchor holes 23, 32, and 38, the guide member 12 to which the hydraulic jack 14 is connected is installed and fixed at the center in the width direction of the guide grooves 60 through the first to third fixing means 15 to 17 (device fixing process). The guide member 12 is positioned at the center in the width direction of the guide groove 60, the cutter 14 is positioned in the cutter installation portion 61, and the bottom wall of the base 49 of the slider 45 is brought into contact with the mortar 21 between the guide grooves 60. Subsequently, the free end portion 25 of the first anchor 24 is inserted into the opening 27 of the pressing plate 26, and the hexagon head nut 28 is screwed with the free end portion 25 so as to firmly fix the pressing plate 26 by the first anchor 24 and the nut 28.

After the pressing plate 26 is fixed, the pressing plate 26 is pressed by the nut 28 toward the outer surface of the mortar 21, the guide member 12 is pressed by the pressing plate 26 toward the outer surface of the mortar 21, and the member 12 is fixed by the pressing plate 26 (fixation by the first fixing means).

During the peeling work in which the cutter 14 is moved forward in one direction, the force for moving the guide member 12 in the direction away from the outer surface of the mortar 21 acts on the guide member 12 from the cutter 14, but since the movement of the guide member 12 in the direction away from the outer surface of the mortar 21 is prevented by the first anchor 24 and the pressing plate 26, the cutting edge 50 of the cutter 14 can be made to reliably bite into the mortar 21.

After the guide member 12 is fixed by the first fixing means 15, the free end portion 34 of the second anchor 33 is inserted into the through hole of the second front end plate 31, the first front end plate 30 is brought into contact with the front end portion 29 (front end) of the guide member 12, the free end portion 34 of the second anchor 33 exposed from the through hole is screwed with the hexagon head nut 28, and the first and second front end plates 30 and 31 are fixed to the outer surface of the mortar 21 by the second anchor 33 and the hexagon head nut 28. The front end portion 29 of the guide member 12 is fixed by the first and second front endplates 30 and 31 (fixation by the second fixing means).

During the work in which the cutter 14 (the piston rod 42) is moved rearward in one direction, the force for moving the guide member 12 forward in the one direction acts on the guide member 12 from the cutter 14, but since the movement of the guide member 12 forward in the one direction is prevented by the first and second front endplates 30 and 31 and the second anchor 33, shifting movement of the guide member 12 and the cutter 14 with respect to the mortar 21 can be prevented, and the cutter 14 can be smoothly retreated rearward in one direction after the peeling process has been performed.

After the front end portion 29 of the guide member 12 is fixed by the second fixing means 16, the free end portion 40 of the third anchor 39 is inserted into the through hole of the second rear end plate 37, the first rear end plate 36 is brought into contact with the rear end portion 35 (rear end) of the guide member 12, the free end portion 40 of the third anchor 39 exposed from the through hole is screwed with the hexagon head nut 28, and the first and second rear end plates 36 and 37 are fixed to the outer surface of the mortar 21 by the third anchor 39 and the hexagon head nut 28. The rear end portion 35 of the guide member 12 is fixed by the first and second rear end plates 36 and 37 (fixation by the third fixing means).

During the peeling work in which the cutter 14 (piston rod 42) is moved forward in one direction, the force for moving the guide member 12 rearward in the one direction acts on the guide member 12 from the cutter 14, but since the movement of the guide member 12 rearward in the one direction is prevented by the first and second rear end plates 36 and 37 and the third anchor 39, shifting movement of the guide member 12 and the cutter 14 with respect to the mortar 21 during the peeling work can be prevented, and the cutting edge 50 of the cutter 14 can be made to reliably bite into the mortar 21.

Figure 8:
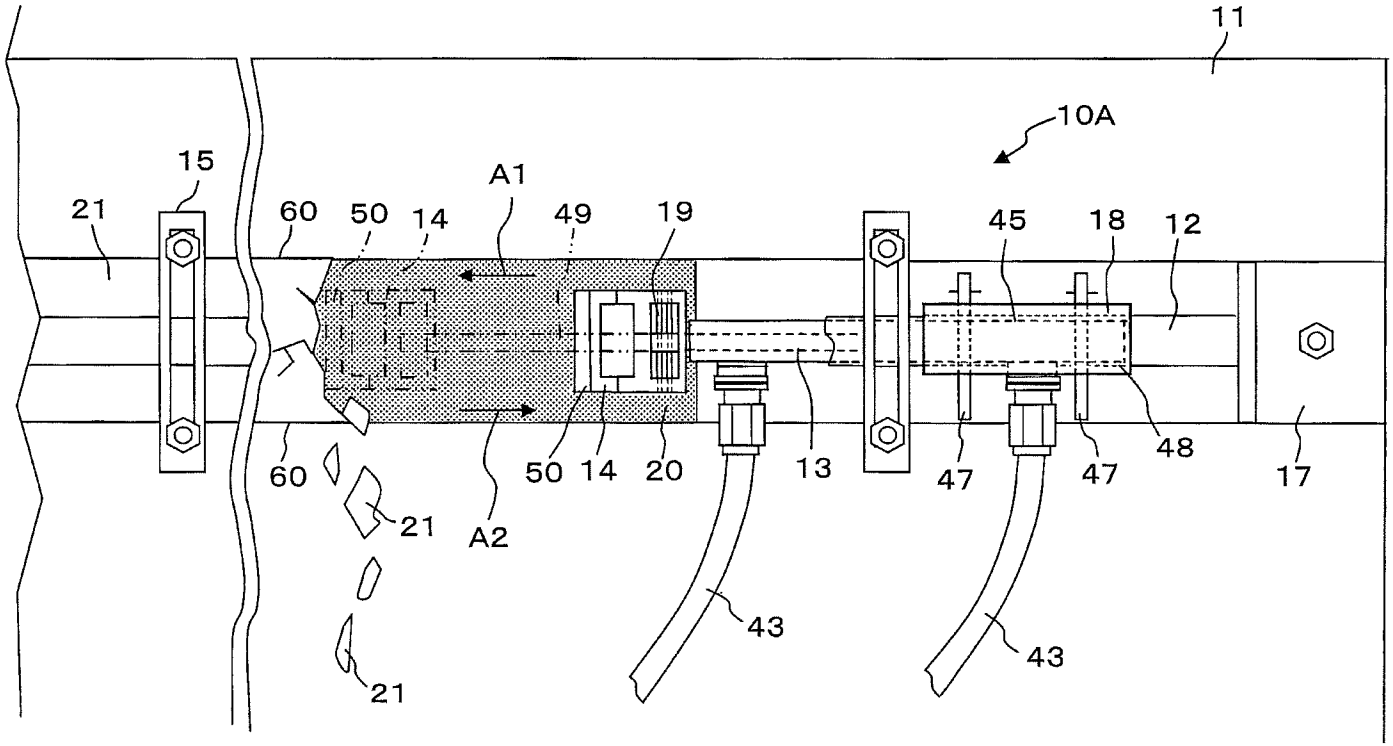
FIG. 8 is a diagram illustrating the mortar peeling method continued from FIG. 7.
Figure 9:
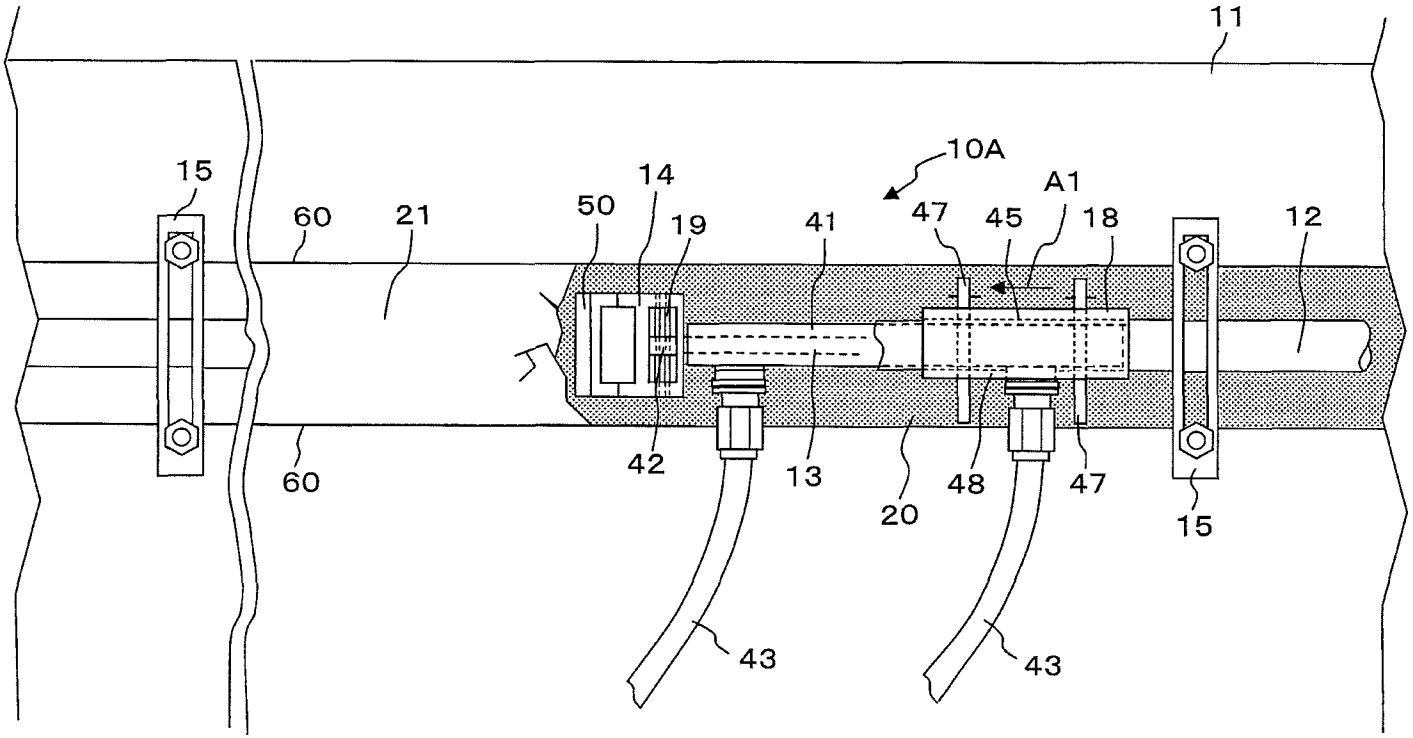
FIG. 9 is a diagram illustrating the mortar peeling method continued from FIG. 8.
Figure 10:
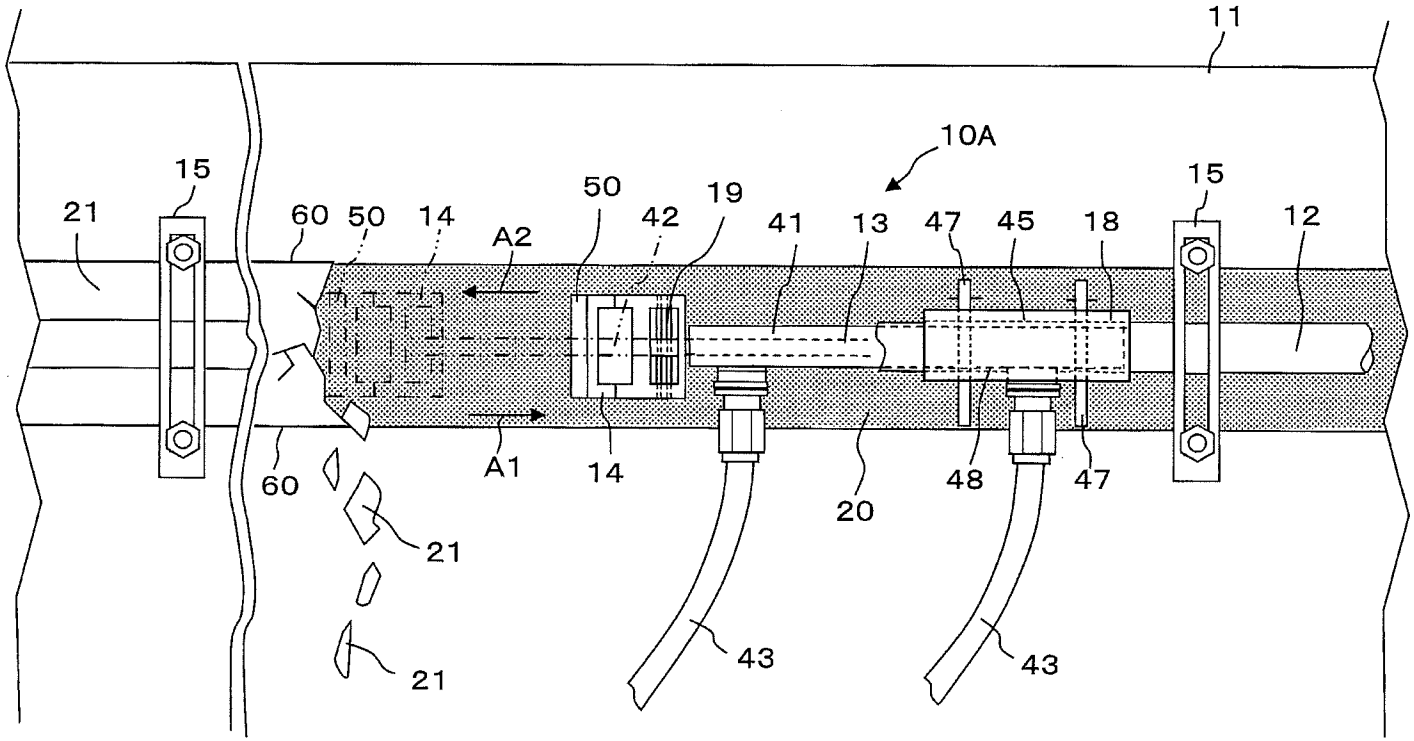
FIG. 10 is a diagram illustrating the mortar peeling method continued from FIG. 9.

FIG. 8 is a diagram illustrating the mortar peeling method continued from FIG. 7, and FIG. 9 is a diagram illustrating the mortar peeling method continued from FIG. 8. FIG. 10 is a diagram illustrating the mortar peeling method continued from FIG. 9. After the device fixing process is completed, the first peeling process (first mortar peeling process) is executed. In the first peeling process, the electric hydraulic pump 44 is switched on, the hydraulic jack 13 is operated by a remote controller, not shown, and the piston rod 42 of the jack 13 is extended (advanced) forward in one direction indicated by an arrow A1 in FIG. 8. By extending the piston rod 42 forward in one direction, the cutter 14 is gradually advanced forward in one direction, and the cutting edge 50 of the cutter 14 gradually peels the mortar 21 with the predetermined thickness off the concrete framework 20 (first peeling process).

After the piston rod 42 of the hydraulic jack 13 is extended to the maximum forward in one direction and the mortar 21 is peeled for a portion by which the rod 42 is extended, the hydraulic jack 13 is operated by the remote controller, and the piston rod 42 of the jack 13 is retreated rearward in one direction indicated by an arrow A2 in FIG. 8. By retreating the rod 42, the first peeling process (one session of the peeling process) is completed. A sound pressure level generated during the peeling of the mortar 21 is within a range of 50 to 80 dB. The sound pressure level is a value measured by a noise meter separated away from the mortar peeling device 10A by 1.2 m. In the mortar peeling method using the mortar peeling device 10A, the cutting edge 50 of the cutter 14 advances forward in one direction, and the cutting edge 50 acts to peel the mortar 21 off, and thus, the cutting surface of the mortar 21 and the cutter 14 (cutting edge 50) do not rub each other, and a large cutting sound is not generated.

After the first peeling process is completed, the connecting pin 47 is pulled out of the through holes 22 and 46 so as to release the connection between the guide member 12 and the hydraulic jack 13. After the connection between the guide member 12 and the hydraulic jack 13 is released, the cylinder member 48 of the slider 45 is moved forward in one direction indicated by the arrow A1 in FIG. 9 on the outer peripheral surface of the guide member 12, and the hydraulic jack 13 is moved forward in one direction (jack first movement process). A maximum moving distance of the jack 13 forward in one direction is a distance until the cutting edge 50 of the cutter 14 is brought into contact with the mortar 21 to be peeled off the next time.

After the hydraulic jack 13 is moved forward in one direction, in the state in which the through holes 22 and 46 are matched with each other, the connecting pin 47 is inserted into those through holes 22 and 46 again so as to connect the hydraulic jack 13 to the guide member 12 again, and the second peeling process is performed. In the second peeling process, the electric hydraulic pump 44 is switched on, the hydraulic jack 13 is operated by the remote controller, and the piston rod 42 of the jack 13 is extended (advanced) forward in one direction indicated by the arrow A1 in FIG. 10.

By extending the piston rod 42 forward in one direction, the cutter 14 is gradually advanced forward in one direction, and the cutting edge 50 of the cutter 14 gradually peels the mortar 21 with the predetermined thickness off the concrete framework 20 (the second peeling process (subsequent mortar peeling process). After the piston rod 42 of the hydraulic jack 13 is extended to the maximum forward one direction, and the mortar 21 is peeled for a portion by which the rod 42 is extended, the hydraulic jack 13 is operated by the remote controller, and the piston rod 42 of the jack 13 is retreated rearward in one direction indicated by an arrow A2 in FIG. 10. By retreating the rod 42, the second peeling process (the subsequent session of the peeling process) is completed.

After the second peeling process is completed, the connecting pin 47 is pulled out of the through holes 22 and 46 so as to release the connection between the guide member 12 and the hydraulic jack 13. After the connection between the guide member 12 and the hydraulic jack 13 is released, the cylinder member 48 of the slider 45 is moved forward in one direction on the outer peripheral surface of the guide member 12, and the hydraulic jack 13 is moved forward in one direction (jack second movement process). After the hydraulic jack 13 is moved forward in one direction, the peeling work of the mortar 21 is performed again with the above described procedure. The jack movement process and the mortar peeling process are repeated in accordance with the peeling length of the mortar 21 (the jack n-th movement process, the mortar n-th peeling process (subsequent mortar peeling process)), and when all the mortar 21 to be peeled off is peeled, the jack movement process and the mortar peeling process are completed.

After the jack movement process and the mortar peeling process are completed, the device removing process is performed. The hexagon head nut 28 screwed with the free end portion 25 of the first anchor 24 is removed from the free end portion 25, fixation of the pressing plate 26 by the first anchor 24 and the nut 28 is released, the pressing plate 26 is pulled out of the free end portion 25 of the first anchor 24, and the fixation of the guide member 12 by the pressing plate 26 is released (release of the fixation by the first fixing means).

Subsequently, the hexagon head nut 28 screwed with the free end portion 34 of the second anchor 33 is removed from the free end portion 34, fixation on the mortar 21 of the first and second front end plates 30 and 31 by the second anchor 33 and the hexagon head nut 28 is released, and the fixation of the front end portion 29 of the guide member 12 by the first and second front end plates 30 and 31 (release of the fixation by the second fixing means).

Moreover, the hexagon head nut 28 screwed with the free end portion 40 of the third anchor 39 is removed from the free end portion 40, the fixation on the mortar 21 of the first and second rear endplates 36 and 37 by the third anchor 39 and the hexagon head nut 28 is released, and the fixation of the rear end portion 35 of the guide member 12 by the first and second rear endplates 36 and 37 is released (release of the fixation by the third fixing means). After the fixation by the first to third fixing means 15 to 17 is released, the guide member 12 is lowered from the inner wall 11, and the mortar peeling device 10A is removed from the peeling spot (device removing process).

After the device removing process is completed, the anchor cutting process is performed. In the anchor cutting process, the free end portions 25, 34, and 40 of the first to third anchors 24, 33, and 39 exposed from the anchor holes 23, 32, and 38 are cut by using the cutter. By completing each of the above described processes, the peeling work of the mortar 21 is completed. If the peeling work is completed in the first session of the peeling process, the device removing process is performed immediately after the first peeling process is completed.

In the mortar peeling method using the mortar peeling device 10A, the mortar peeling process is executed by gradually extending the piston rod 42 of the hydraulic jack 13 forward in one direction, the cutting edge 50 of the cutter 14 is gradually advanced forward in one direction so that the mortar 21 with the predetermined thickness is peeled off the concrete framework 20 by using the cutting edge 50, a large cutting sound caused by rubbing between the cutting surface of the mortar 21 and the cutter 14 (cutting edge 50) is not generated, and a sound generated during the peeling work can be kept to an allowable quiet sound (sound with a sound pressure level of 50 to 80 dB) while the mortar 21 can be peeled off the concrete framework 20.

In the mortar peeling method, the force (torque) is linearly transmitted from the piston rod 42 of the hydraulic jack 13 to the cutting edge 50 of the cutter 14, the linear force of the cutting edge 50 can be concentrated on the peeling spot of the mortar 21, whereby a large peeling force acts on the mortar 21, and thus, even if the peeling width, the peeling length or the peeling depth of the mortar 21 to be peeled off is large and the mortar 21 is firmly constructed, the mortar 21 can be peeled off smoothly and reliably.

In the mortar peeling method, since the mortar 21 can be smoothly peeled off the concrete framework 20 by using the hydraulic jack 13 and the cutter 14, not only that the peeling work can be completed efficiently in a short period of time (short construction period) but also the mortar 21 can be peeled off the concrete framework 20 over a wide range once, and the peeling work can be performed inexpensively.

In the mortar peeling method, since unnecessary vibration is not transmitted to the concrete framework 20 during the peeling work of the mortar 21, the mortar 21 can be peeled off without damaging the concrete framework 20. Moreover, the mortar 21 can be peeled off the concrete framework 20 uniformly in a short period of time with high accuracy, generation of fine particles and dusts during the peeling work is less, and the peeling work can be performed in a favorable environment.

In the mortar peeling method, after the peeling for a portion of the maximum extended dimension of the piston rod 42 has been performed, the removed hydraulic jack 13 can be moved forward in one direction and connected to the guide member 12 again, and the peeling for the portion of the maximum extended dimension of the piston rod 42 can be performed and thus, the mortar peeling process can be performed repeatedly, and all the mortar 21 can be peeled off the concrete framework 20 even if the peeling length of the mortar 21 in the inner wall 11 is long. In the mortar peeling method, the hydraulic jack 13 is simply moved forward in one direction and the jack 13 is connected to the guide member 12 as the work for performing the mortar peeling process repeatedly and other works are not involved and thus, the peeling work of the mortar 21 can be completed without labor in a short period of time and with efficiency.

Figure 11:
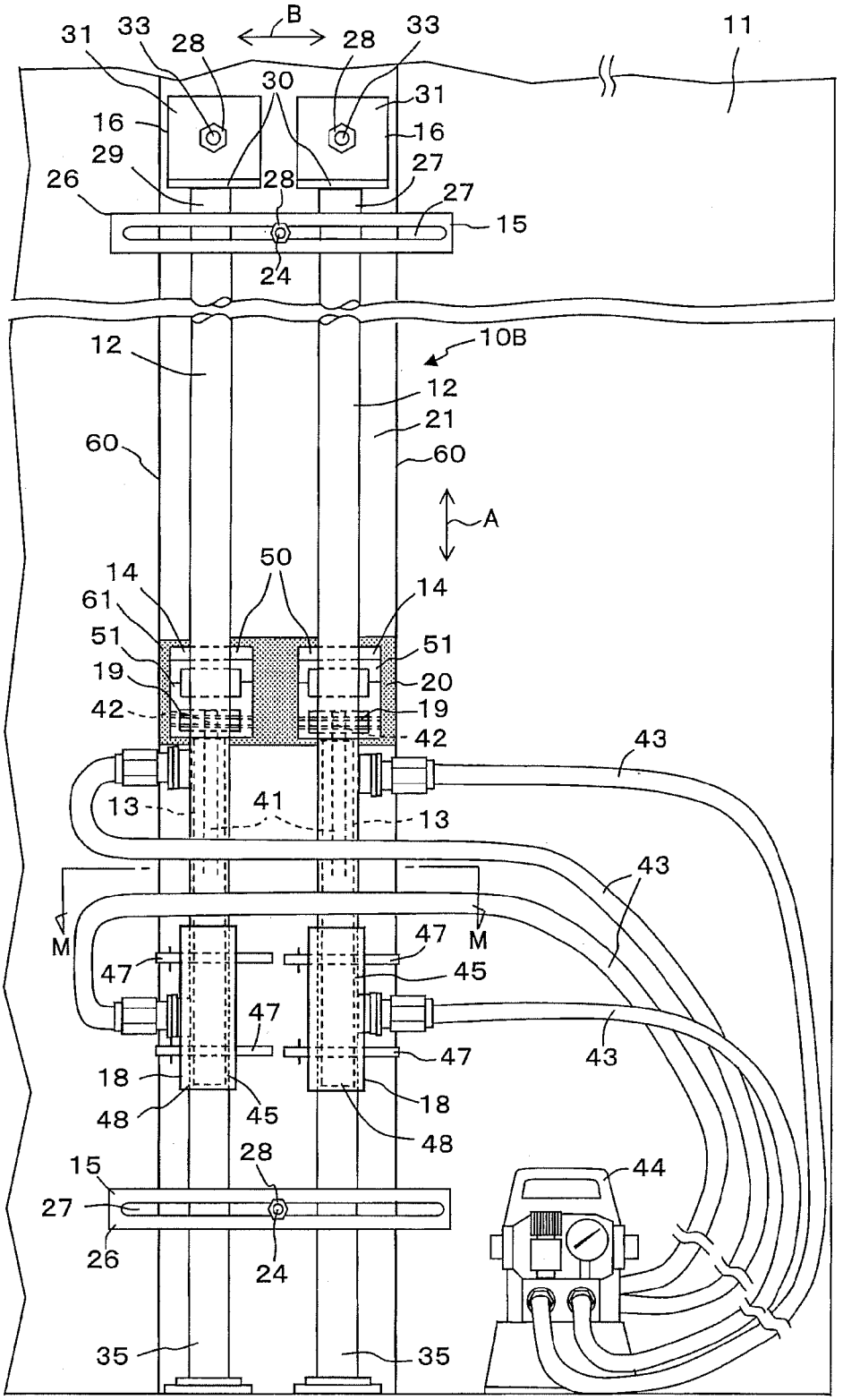
FIG. 11 is a top view of the mortar peeling device illustrated as another example.
Figure 12:
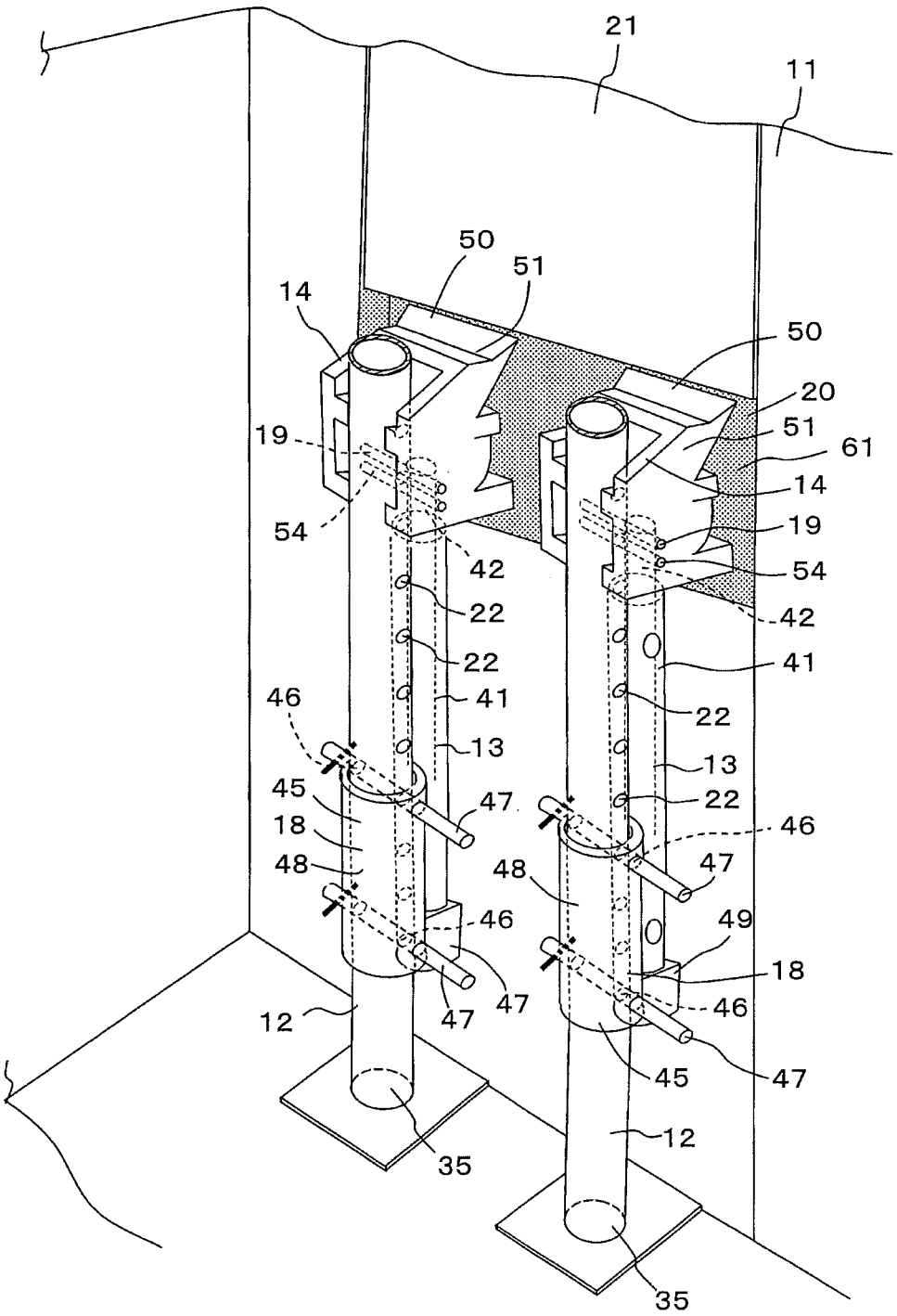
FIG. 12 is a perspective view of the mortar peeling device in FIG. 11.
Figure 13:
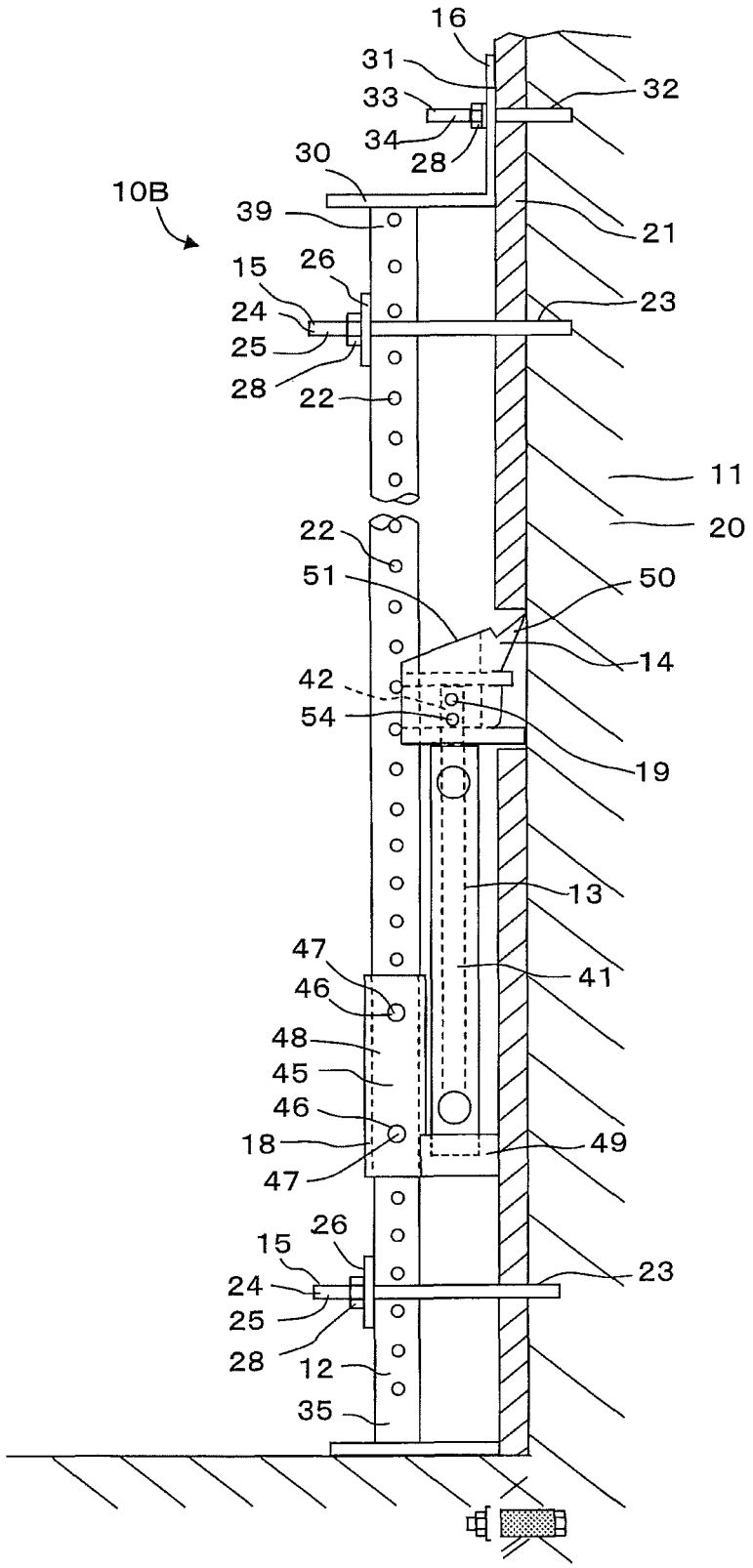
FIG. 13 is a side view of the mortar peeling device in FIG. 11.
Figure 14:
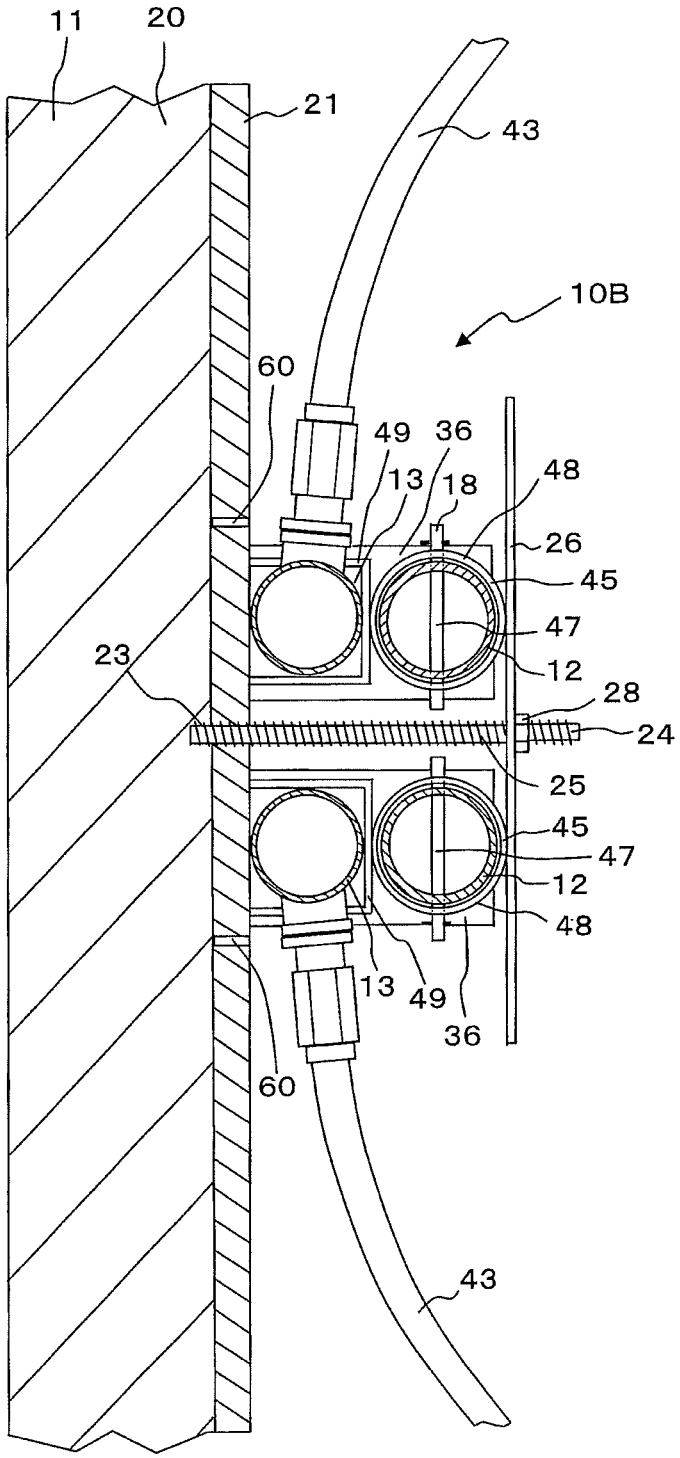
FIG. 14 is a sectional view on an arrow of M-M line in FIG. 11.

FIG. 11 is a top view of a mortar peeling device 10B illustrated as another example, and FIG. 12 is a perspective view of the mortar peeling device 10B in FIG. 11. FIG. 13 is a side view of the mortar peeling device 10B in FIG. 11, and FIG. 14 is a sectional view on an arrow of M-M line in FIG. 11. In FIG. 11, one direction (vertical direction in a building illustrated in FIG. 11) is indicated by the arrow A, and a direction (transverse direction in the building illustrated in FIG. 11) crossing the one direction is indicated by the arrow B. In FIGS. 11 and 12, the mortar peeling device 10B is illustrated in a state installed on the inner wall 11. In FIG. 12, the first fixing means 15 and the front end portion 29 of the guide member 12 are not shown.

This mortar peeling device 10B is used for peeling of the mortar 21 constructed on the outer surface of the concrete framework 20 on the inner wall 11 of the reinforced concrete building. The mortar peeling device 10B is provided with two guide members 12 extending in one direction, two hydraulic jacks 13, two cutters 14, first to second fixing means 15 and 16, and first to second connecting means 18 and 19.

Those guide members 12 are juxtaposed in parallel away from each other in a lateral direction. Each of the guide members 12 is a hollow cylindrical metal pipe (iron pipe, aluminum pipe, stainless pipe and the like) extending in one direction, similarly to that in FIG. 1, and a sectional shape thereof is molded circularly. The guide members 12 are separated away from the outer surface of the mortar 21 by a predetermined dimension and are installed on the inner wall 11 of the building so as to be in parallel with the outer surface of the mortar 21. The guide member 12 has a length dimension equal to or longer than the peeling length of the mortar 21 to be peeled. In those guide members 12, a plurality of the through holes 22 (first connecting means 18) penetrating the same and juxtaposed at equal intervals (separated away by the predetermined dimension) in one direction are drilled. The guide member 12 is installed and fixed on the inner wall 11 by the first and second fixing means 15 and 16.

The first fixing means 15 are juxtaposed in one direction away from each other by a predetermined dimension and prevent movement of the guide member 12 in a direction away from the outer surface of the mortar 21. The first fixing means 15 is composed of the first anchor 24 inserted and fixed to the anchor hole 23 drilled in the inner wall 11 and the pressing plate 26 detachably fixed to the free end portion 25 of the anchor 24 exposed from the anchor hole 23. The single first anchor 24 is arranged between the guide members 12.

The pressing plate 26 is the same as that used for the peeling device 10A in FIG. 1, and the free end portion 25 of the first anchor 24 is inserted into its opening 27. A male screw formed on the free end portion 25 of the first anchor 24 is screwed with the hexagon head nut 28. The pressing plate 26 is pressed by the nut 28 toward the outer surface of the mortar 21, and the pressing plate 26 is fixed by the first anchor 24 and the nut 28, and those guide members 12 are pressed by the pressing plate 26 toward the outer surface of the mortar 21.

The second fixing means 16 is installed on the front end portion 29 of the guide member 12 and prevents movement of the guide member 12 forward in one direction. The second fixing means 16 is composed of the first front end plate 30 brought into contact with the front end portion 29 of the guide member 12, the second front end plate 31 connected to the first front end plate 30 and brought into contact with the inner wall 11 (mortar 21), and the second anchor 33 inserted into the anchor hole 32 drilled in the inner wall 11 (the concrete framework 20 and the mortar 21). The first and second front end plates 30 and 31 are the same, as those used for the peeling device 10A, and the free end portion 34 of the second anchor 33 is inserted into the through hole of the second front end plate 31.

The male screw formed on the free end portion 34 of the second anchor 33 is screwed with the hexagon head nut 28. The first and second front end plates 30 and 31 are fixed to the inner wall 11 by the second anchor 33 and the hexagon head nut 28. The rear end portion 35 (rear end) of the guide member 12 is brought into contact with a floor slab, and since movement of the guide member 12 rearward in one direction is prevented by the floor slab, unlike the peeling device 10A in FIG. 1, installation of the third fixing means 17 is omitted.

Those hydraulic jacks 13 are located between the guide members 12 and the mortar 21 and detachably connected to the rear end portion of the guide members 12 through the first connecting means 18. Since the hydraulic jack 13 is the same as that used for the peeling device 10A in FIG. 1, the explanation will be omitted. The first connecting means 18 is composed of the slider 45 connected to the rear end portion of the hydraulic cylinder 41, the through hole 22 drilled in the guide member 12, the through hole 46 drilled in the slider 45, and the connecting pin 47.

The slider 45 is composed of the cylindrical cylinder member 48 detachably fitted with the outer peripheral surface of the guide member 12 and the base 49 connected to the rear end portion of the cylinder member 48. The cylinder member 48 is slidable forward in one direction and rearward in one direction on the outer peripheral surface of the guide member 12. Inside of the base 49, the rear end portion of the hydraulic cylinder 41 is accommodated, and the rear end portion of the cylinder 41 is fixed to the base 49 by welding. The bottom wall of the base 49 is brought into contact with the outer surface of the mortar 21.

After the cylinder member 48 of the slider 45 is fitted with the outer peripheral surface of the guide member 12, and the through holes 22 and 46 are matched with each other, by inserting the connecting pin 47 into those through holes 22 and 46, the hydraulic jack 13 can be connected to the guide member 12. On the contrary, by pulling the connecting pin 47 out of the through holes 22 and 46, the connection between the hydraulic jack 13 and the guide member 12 can be released. After the connection between the hydraulic jack 13 and the guide member 12 is released, by sliding the slider 45 forward in one direction or rearward in one direction and by inserting the connecting pin 47 into those through holes 22 and 46, the hydraulic jack 13 can be installed at a predetermined spot of the guide member 12.

The cutter 14 is composed of the cutting edge 50 and the mounting base 51 and is detachably connected to the tip end portion of the piston rod 42 through the second connecting means 19 (see FIG. 5). The second connecting means 19 is composed of the two through holes 52 drilled in the tip end portion of the piston rod 42, the two through holes 53 drilled in the mounting base 51 of the cutter 14, and the connecting pin 54. The cutting edge 50 is located at a predetermined depth from the outer surface of the mortar 21 and is brought into contact with the outer surface of the concrete framework 20.

The top portion 55 of the mounting base 51 is slidably brought into contact with the outer peripheral surface of the guide member 12, whereby movement of the cutting edge 50 in a direction away from the outer surface of the concrete framework 20 is prevented. In the intermediate portion 56 of the mounting base 51, the insertion hole 58 into which the tip end portion of the piston rod 42 is removably inserted and the contact surface 59 with which the tip end of the rod 42 is brought into contact are formed. The bottom portion 59 of the mounting base 51 is brought into contact with the outer surface of the mortar 21.

In a state in which the tip end portion of the piston rod 42 is inserted into the insertion hole 58 of the mounting base 51, the tip end of the rod 42 is brought into contact with the contact surface 59 of the mounting base 51, and the through holes 52 and 53 are matched with each other, by inserting the connecting pin 54 into those through holes 52 and 53, the cutter 14 can be connected to the tip end portion of the piston rod 42. On the contrary, by pulling the connecting pin 54 out of those thorough holes 52 and 53, the connection between the cutter 14 and the piston rod 42 can be released. When the piston rod 42 of the hydraulic jack 13 is extended forward in one direction, the cutter 14 (cutting edge 50) moves forward in one direction with that, while, when the rod 42 is retreated rearward in one direction, the cutter 14 moves rearward in one direction with that.

Figure 15:
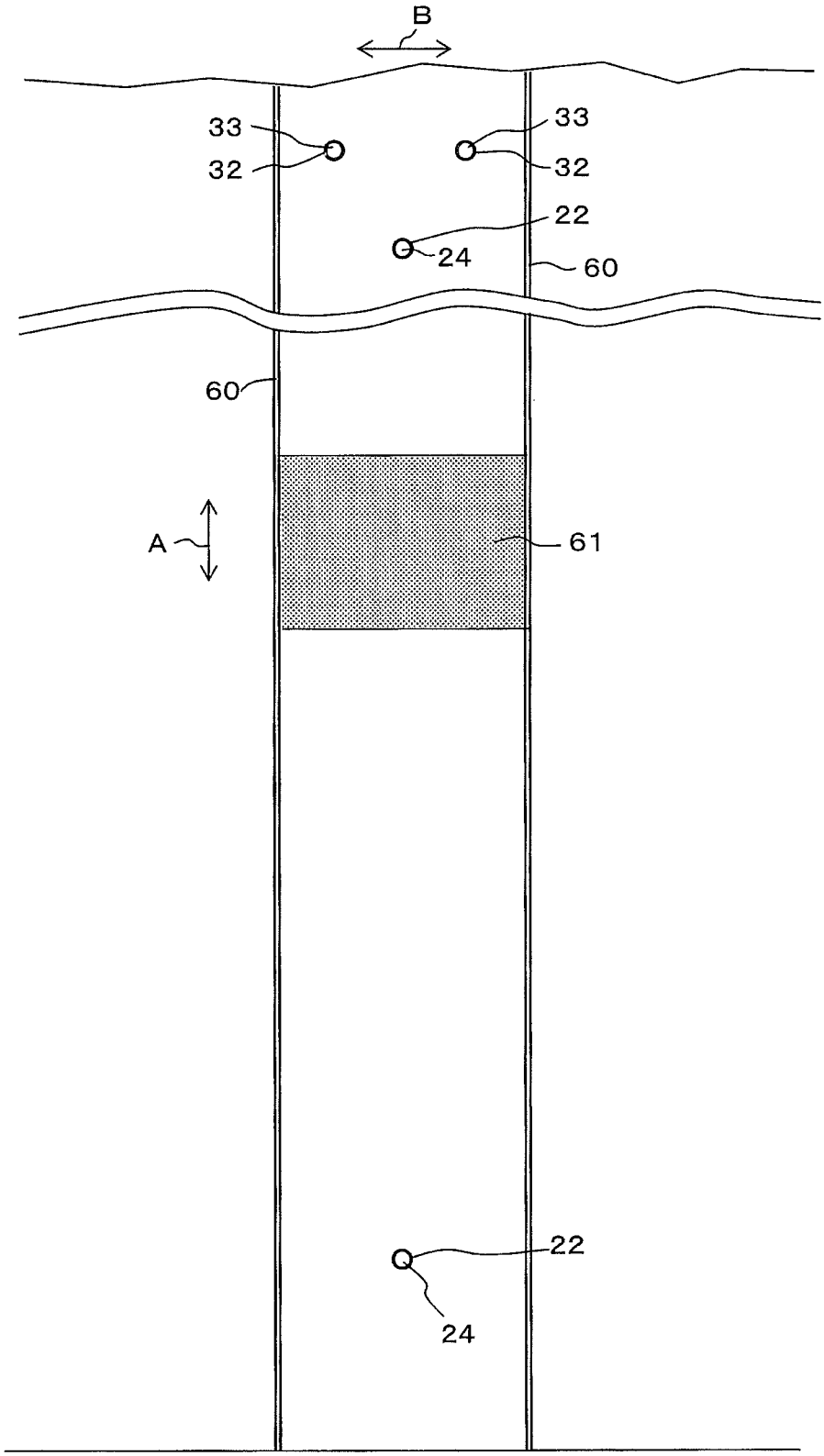
FIG. 15 is a diagram illustrating an example of the mortar peeling method using the mortar peeling device.
Figure 16:
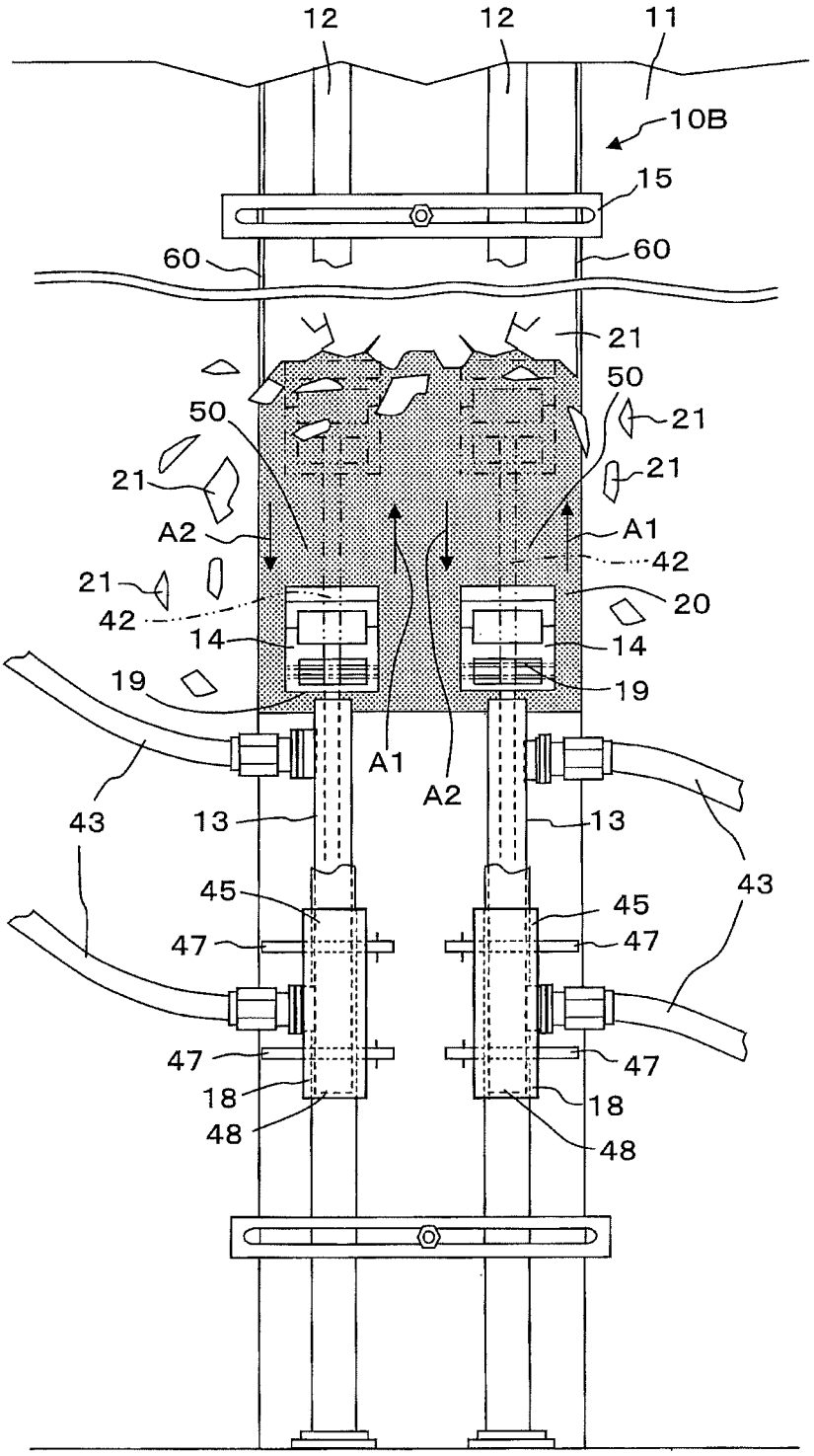
FIG. 16 is a diagram illustrating the mortar peeling method continued from FIG. 15.
Figure 17:
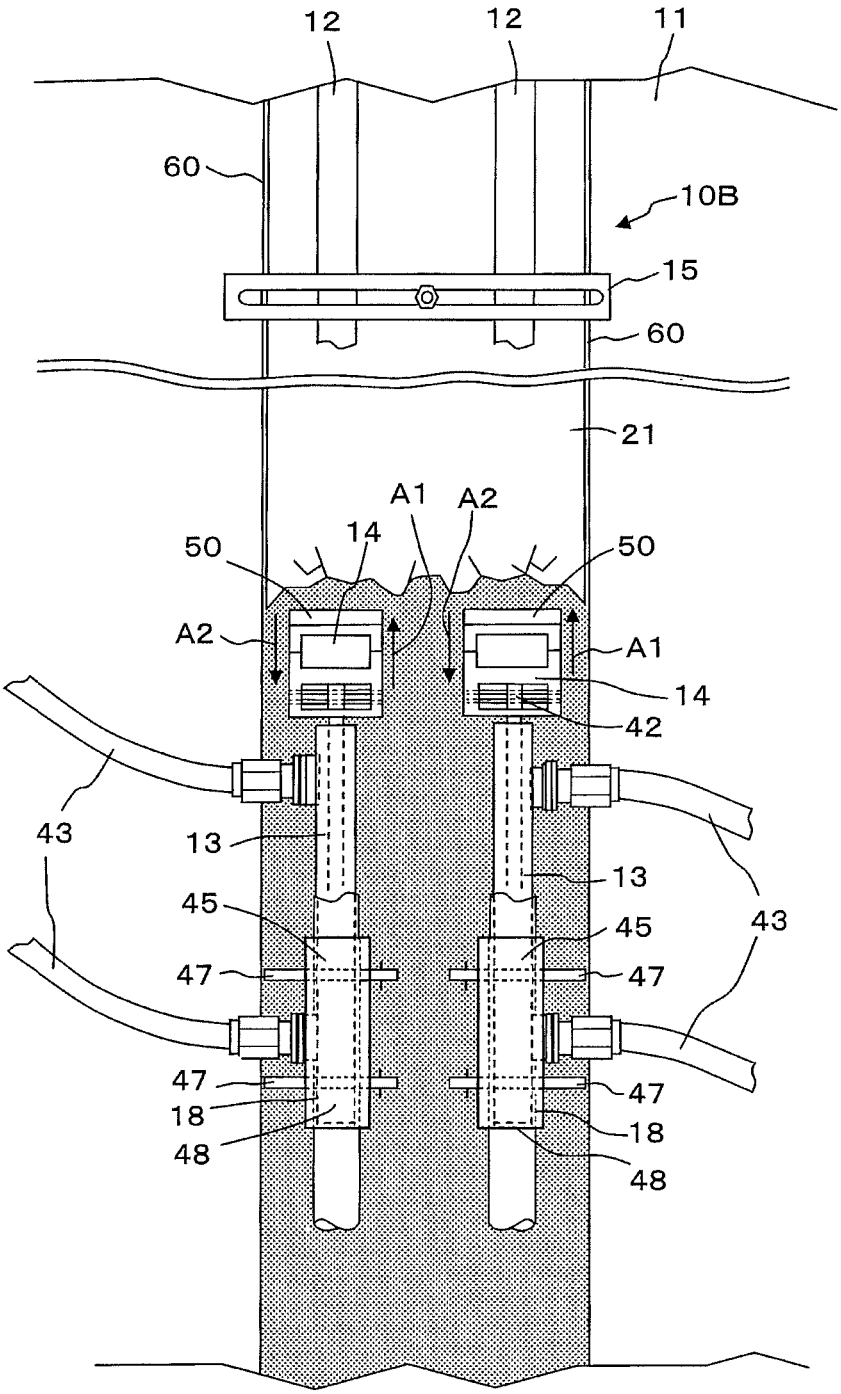
FIG. 17 is a diagram illustrating the mortar peeling method continued from FIG. 16.
Figure 18:
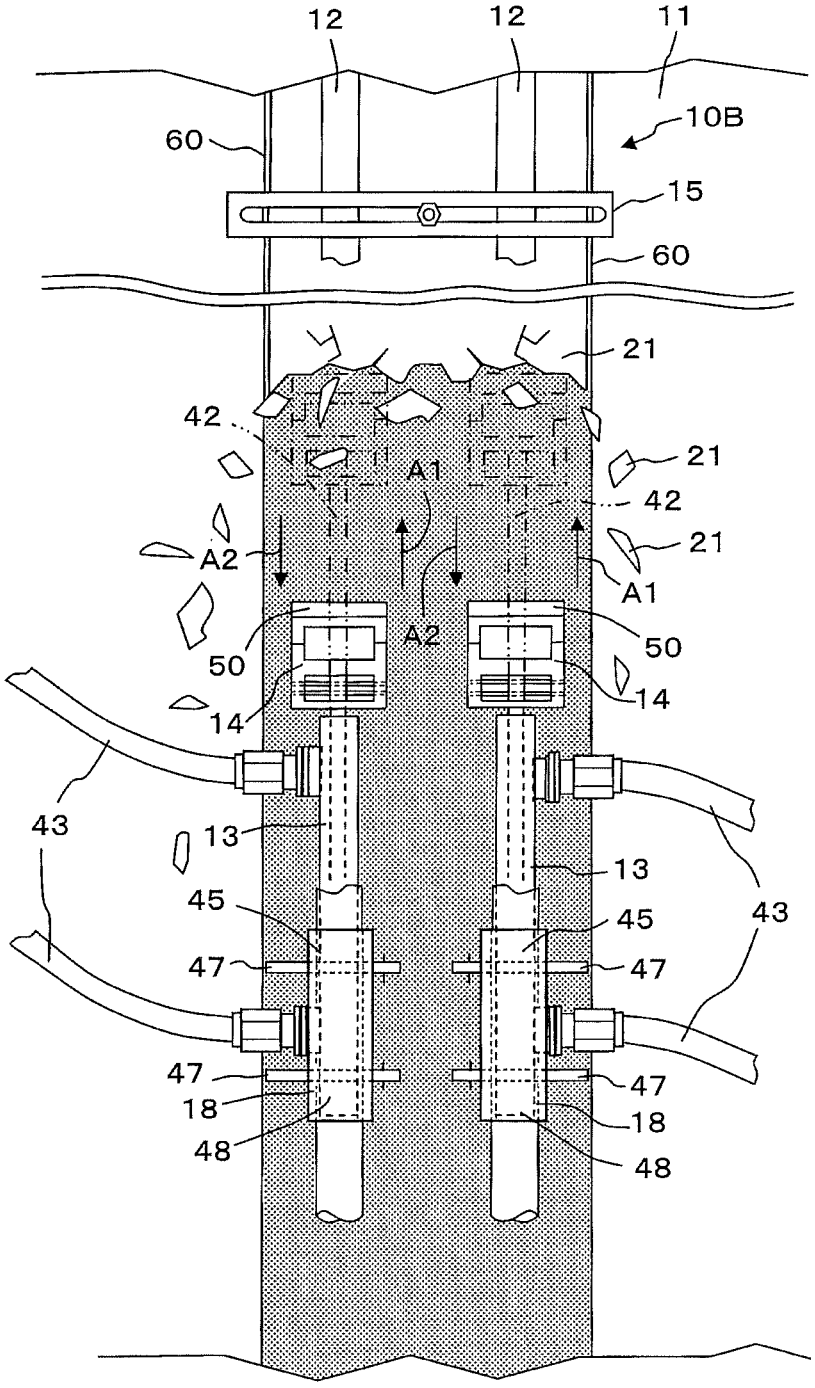
FIG. 18 is a diagram illustrating the mortar peeling method continued from FIG. 17.

FIG. 15 is a diagram illustrating an example of the mortar peeling method of the mortar 21 using the mortar peeling device 10B, and FIG. 16 is a diagram illustrating the mortar peeling method continued from FIG. 15. FIG. 17 is a diagram illustrating the mortar peeling method continued from FIG. 16, and FIG. 18 is a diagram illustrating the mortar peeling method continued from FIG. 17. In FIG. 15, one direction (vertical direction in a building illustrated in FIG. 15) is indicated by the arrow A, and a direction crossing the one direction (transverse direction in the building illustrated in FIG. 15) is indicated by the arrow B. The mortar peeling method will be described on the basis of those figures as follows. Similarly to the mortar peeling method using the mortar peeling device 10A in FIG. 1, a peeling spot on the inner wall 11 where the mortar 21 is to be peeled is determined in advance, a peeling width dimension of the mortar 21 is determined, a peeling length dimension of the mortar 21 is determined, and a peeling depth dimension of the mortar 21 is determined.

After those dimensions are determined, the device installation process of installing those mortar peeling devices 10B at the peeling spots of the mortar 21 is performed. The tip end portion of the piton rod 42 is inserted into the insertion hole 58 of the mounting base 51, the tip end of the rod 42 is brought into contact with the contact surface 59 of the mounting base 51, and in a state in which the through holes 52 and 53 are matched with each other, the connecting pin 54 is inserted into those through holes 52 and 53, and the tip end portion of the rod 42 is connected to the cutter 14 by the second connecting means 19. The cylinder member 48 of the slider 45 is fitted with the outer peripheral surface of the guide member 12, and in a state in which the through holes 22 and 46 are matched with each other, the connecting pin 47 is inserted into those through holes 22 and 46, and the hydraulic jack 13 is connected to the guide member 12 by the first connecting means 18 (device preparation process).

In parallel with the device preparation process or after the mortar peeling device 10A is prepared in the device preparation process, as illustrated in FIG. 15, the two guide grooves 60 extending linearly in one direction along the outer edge of the peeling width of the mortar 21 are formed (guide groove creating process). After the guide grooves 60 are created, by using a core drill, the mortar 21 at a spot between the guide grooves 60 is peeled off, and the cutter installation portions 61 in which the cutters 14 are fitted are drilled at the spot (cutter installation portion creating process). After the guide grooves 60 are created, and the cutter installation portions 61 are created, the cylindrical anchor holes 22 and 32 are drilled at spots where the first and second fixing members 15 and 16 are to be installed, and the first and second anchors 24 and 33 are installed and fixed to those anchor holes 22 and 32 (anchor fixing process).

After the anchors 24 and 33 are fixed to the anchor holes 23 and 32, respectively, those guide members 12 to which the hydraulic jacks 14 are connected are installed and fixed at the center in the lateral direction of the guide groove 60 through the first and second fixing means 15 and 16 (device fixing process). Those guide members 12 are positioned at the center in the lateral direction of the guide groove 60, the cutter 14 is positioned in the cutter installation portion 61, and the bottom wall of the base 49 of the slider 45 is brought into contact with the mortar 21 between the guide grooves 60.

Subsequently, the free end portion 25 of the first anchor 24 is inserted into the opening 27 of the pressing plate 26, the hexagon head nut 28 is screwed with the free end portion 25, and the pressing plate 26 is firmly fixed by the first anchor 24 and the nut 28. When the pressing plate 26 is fixed, the pressing plate 26 is pressed by the nut 28 toward the outer surface of the mortar 21, and the guide member 12 is pressed by the pressing plate 26 toward the outer surface of the mortar 21, and the member 12 is fixed by the pressing plate 26 (fixation by the first fixing means).

After the guide member 12 is fixed by the first fixing means 15, the free end portion 34 of the second anchor 33 is inserted into the through hole of the second front end plate 31, the first front end plate 30 is brought into contact with the front end portion 29 (front end) of the guide member 12, the hexagon head nut 28 is screwed with the free end portion 34 of the second anchor 33 exposed from the through hole, and the first and second front end plates 30 and 31 are fixed to the outer surface of the mortar 21 by the second anchor 33 and the hexagon head nut 28. The front end portion 29 of the guide member 12 is fixed by the first and second front endplates 30 and 31 (fixation by the second fixing means). In the state in FIG. 16 in which the guide members 12 to which the hydraulic jacks 13 are connected are fixed to the inner wall 11, the cutting edges 50 of the cutters 14 connected to those jacks 13 are juxtaposed in the lateral direction.

After the device fixing process is completed, the electric hydraulic pump 44 is switched on, those hydraulic jacks 13 are operated by the remote controller, and the piston rods 42 of the jacks 13 are extended (advanced) forward in one direction indicated by the arrow A1 in FIG. 16. As a result, those cutters 14 are gradually advanced forward in one direction in synchronization, each of the cutting edges 50 of the cutters 14 gradually peels the mortar 21 with the predetermined thickness off the concrete framework 20 (first peeling process, first mortar peeling process).

While the piston rods 42 of those hydraulic jacks 13 are extended to the maximum forward in one direction in synchronization, and after the mortar 21 is peeled for a portion by which the rods 42 are extended, the rods 42 of the jacks 13 are retreated in synchronization rearward in one direction indicated by the arrow A2 in FIG. 16. By retreating those piston rods 42, the first peeling process (a session of the peeling process) is completed. The sound pressure level generated during the peeling of the mortar 21 is within a range of 50 to 80 dB. The sound pressure level is a value measured by a noise meter separated away from the mortar peeling device 10B by 1.2 m. In the mortar peeling method using the mortar peeling device 10B, since the cutting edges 50 of those cutters 14 linearly advance forward in one direction in synchronization and act so that the cutting edges 50 peel the mortar 21 off, the cutting surface of the mortar 21 is not rubbed with the cutter 14 (cutting edge 50), and a large cutting sound is not generated.

After the first peeling process is completed, the connecting pin 47 is pulled out of the through holes 22 and 46, the connection between the guide member 12 and the hydraulic jack 13 is released, the cylinder member 48 of the slider 45 is moved forward in one direction indicated by the arrow A1 in FIG. 17 on the outer peripheral surface of the guide member 12, and the hydraulic jack 13 is moved forward in one direction (jack first movement process). After the hydraulic jack 13 is moved forward in one direction, the connecting pin 47 is inserted into the through holes 22 and 46 again so as to connect the hydraulic jack 13 to the guide member 12 again, the jack 13 is operated by the remote controller, and the piston rods 42 of those jacks 13 are extended (advanced) forward in one direction indicated by the arrow in FIG. 18.

At this time, similarly to the first peeling process, those piston rods 42 are operated in synchronization, and in the state in which the cutting edges 50 of the cutters 14 are aligned in the lateral direction, the cutters 14 extend (advance) forward in one direction at the same speed. As a result, those cutters 14 gradually advance forward in one direction in synchronization, and each of the cutting edges 50 of the cutters 14 gradually peels the mortar 21 with the predetermined thickness off the concrete framework 20 (second peeling process (subsequent mortar peeling process)).

After the piston rods 42 of the hydraulic jacks 13 are extended to the maximum forward in one direction, and the mortar 21 is peeled for the portion by which the rods 42 are extended, the hydraulic jacks 13 are operated by the remote controller and the rods 42 of the jacks 13 are retreated rearward in one direction indicated by the arrow A2 in FIG. 18 in synchronization. By retreating those rods 42, the second peeling process (a subsequent session of the peeling process) is completed.

After the second peeling process is completed, the connecting pin 47 is pulled out of the through holes 23 and 46, the connection between those guide members 12 and those hydraulic jacks 13 is released, the cylinder member 48 of the slider 45 is moved forward in one direction on the outer peripheral surface of the guide member 12, and the hydraulic jack 13 is moved forward in one direction (jack second movement process). After those hydraulic jacks 13 are moved forward in one direction, the peeling work of the mortar 21 is performed again with the above described procedure. The movement process and the peeling process are repeated in accordance with the peeling length of the mortar 21 (the jack n-th movement process, the mortar n-th peeling process (subsequent mortar peeling process)), and when all the mortar 21 to be peeled off is peeled, the jack movement process and the mortar peeling process are completed.

After the jack movement process and the mortar peeling process are completed, the hexagon head nut 28 screwed with the free end portion 25 of the first anchor 24 is removed, fixation of the pressing plate 26 by the first anchor 24 and the nut 28 is released, and the pressing plate 26 is pulled out of the free end portion 25 of the first anchor 24 so as to release fixation of the guide member 12 by the pressing plate 26 (release of the fixation by the first fixing means).

Subsequently, the hexagon head nut 28 screwed with the free end portion 34 of the second anchor 33 is removed, the fixation of the first and second front end plates 30 and 31 to the mortar 21 by the second anchor 33 and the hexagon head nut 28 is released, and the fixation of the front end portion 29 of the guide member 12 by the first and second front end plates 30 and 31 is released (release of the fixation by the second fixing means). After the fixation by the first and second fixing means 15 and 16 is released, the guide member 12 is lowered from the inner wall 11, and the mortar peeling device 10B is removed from the peeling spot (device removing process).

After the device removing process is completed, the anchor cutting process is performed. In the anchor cutting process, the free end portions 25 and 34 of the first to third anchors 24 and 33 exposed from the anchor holes 23 and 32 are cut by using the cutter. By completing each of the above described processes, the peeling work of the mortar 21 is completed. If the peeling work is completed in the first session of the peeling process, the device removing process is performed immediately after the first peeling process is completed.

In the mortar peeling method using the mortar peeling device 10B, by gradually extending the piston rods 42 of those hydraulic jacks 13 forward in one direction in synchronization, each of the cutting edges 50 of the cutters 14 is gradually advanced forward in one direction, and the mortar peeling process for peeling the mortar 21 with the predetermined thickness off the concrete framework 20 is executed by using those cutting edges 50, and thus, a large cutting sound caused by rubbing between the cutting surface of the mortar 21 and the cutter 14 (cutting edge 50) is not generated, and the mortar 21 can be peeled off the concrete framework 20 while a sound generated during the peeling work is kept to an allowable quiet sound.

In the mortar peeling method, the force (torque) is linearly transmitted from the piston rods 42 of those hydraulic jacks 13 to each of the cutting edges 50 of the cutters 14, the linear force of those cutting edges 50 can be concentrated on the peeling spot of the mortar 21 by which the large peeling force acts on the mortar 21, and thus, even if the mortar 21 to be peeled has large peeling width, peeling length or peeling depth and is constructed firmly, the mortar 21 can be peeled off smoothly and reliably.

In the mortar peeling method, since the cutting edges 50 of the cutters 14 installed on the guide members 12, respectively, are advanced forward in one direction in synchronization, the linear force of the cutting edges 50 is uniformly transmitted from those cutting edges 50 to the mortar 21, the mortar 21 can be peeled once over a range which is wide in the lateral direction, and a large quantity of the mortar 21 can be peeled off in one session of the peeling work.

In the mortar peeling method, since the mortar 21 can be peeled smoothly off the concrete framework 20 by using the hydraulic jacks 13 and the cutters 14, not only that the peeling work can be completed efficiently in a short period of time (short construction period) but also the mortar 21 can be peeled off the concrete framework 20 over a wide range at once, and the peeling work can be performed inexpensively.

In the mortar peeling method, since unnecessary vibration is not transmitted to the concrete framework 20 during the peeling work of the mortar 21, the mortar 21 can be peeled without damaging the concrete framework 20. Moreover, a large area of the mortar 21 can be peeled off the concrete framework 20 uniformly in a short period of time with high accuracy, generation of fine particles and dusts during the peeling work is less, and the peeling work can be performed in a favorable environment.

In the mortar peeling method, after peeling for a portion of the maximum extended dimension of those piston rods 42 is performed, those removed hydraulic jacks 13 are moved forward in one direction and connected to the guide members 12 again and peeling for the portion of the maximum extended dimension of the piston rod 42 can be further performed, and thus, the mortar peeling process can be performed repeatedly, and even if the peeling length of the mortar 21 in the inner wall 11 is large, all the mortar 21 can be peeled off the concrete framework 20. In the mortar peeling method, it is only necessary to move those hydraulic jacks 13 forward in one direction and to connect them to the guide members 12 as the work of repeatedly performing the mortar peeling process, and no other work is involved and thus, the peeling work of the mortar 21 can be completed efficiently without labor in a short period of time.

REFERENCE SIGNS LIST

10A peeling device
10B peeling device
11 inner wall
12 guide member
13 hydraulic jack (jack)
14 cutter
15 first fixing means
16 second fixing means
17 third fixing means
18 first connecting means
19 second connecting means
20 concrete framework
21 mortar
22 through hole
23 anchor hole
24 first anchor
25 free end portion
26 pressing plate
29 front end portion
30 first front end plate
31 second front end plate
32 anchor hole
33 second anchor
34 free end portion
35 rear end portion
36 first rear end plate
37 second rear end plate
38 anchor hole
39 third anchor
40 free end portion
41 cylinder
42 piston rod
44 electric hydraulic pump
45 slider
46 through hole
47 connecting pin
48 cylinder member
49 base
50 cutting edge
51 mounting base
52 through hole
53 through hole
54 connecting pin
60 guide groove
61 cutter installation hole

The invention claimed is:

1. A mortar peeling method using a mortar peeling device for peeling a mortar constructed on a concrete framework, characterized in that said mortar peeling device includes a guide member separated away from an outer surface of said mortar by a predetermined dimension and extending in one direction in parallel with the outer surface of the mortar, a jack having a piston rod capable of extending forward in one direction and located between said mortar and said guide member, a cutter located at a tip end portion of said piston rod and peeling the mortar off said concrete framework, jack connecting means for connecting said jack to said guide member at a predetermined spot, and first fixing means for fixing said guide member and said jack to a peeling spot of said mortar; and said mortar peeling method performs a mortar peeling process of peeling the mortar having a predetermined thickness off said concrete framework using said cutter by gradually advancing said cutter forward in one direction by gradually extending the piston rod of said jack forward in one direction.

2. The mortar peeling method according to claim 1, wherein in said mortar peeling method, after the piston rod of said jack is extended forward in one direction, and a mortar is peeled, said piston rod is retreated rearward in one direction so as to complete a session of a mortar peeling process, and after the first mortar peeling process is executed, a jack movement process of releasing connection between said jack and said guide member and moving the jack forward in one direction is executed in said mortar peeling method, and a subsequent mortar peeling process of connecting the jack to the guide member again after said jack is moved forward in one direction, of gradually advancing said cutter forward in one direction by gradually extending said piston rod forward in one direction and of peeling the mortar having a predetermined thickness off said concrete framework by using the cutter are executed.

3. The mortar peeling method according to claim 2, wherein in said mortar peeling method, prior to execution of said first mortar peeling process, a guide groove creating process of creating two guide grooves extending linearly in one direction along an outer edge of a peeling width of said mortar is executed, and a cutter installation portion creating process of chipping the mortar at a spot between said guide grooves and of drilling a cutter installation portion where said cutter is to be installed is executed.

4. The mortar peeling method according to claim 2, wherein said mortar peeling device includes cutter connecting means for detachably connecting said cutter to the tip end portion of said piston rod, and in said mortar peeling method, prior to execution of said first mortar peeling process, a device preparation process of preparing said mortar peeling device by connecting said jack to said guide member at a predetermined spot through the jack connecting means while connecting said cutter to the tip end portion of said piston rod through said cutter connecting means is executed, and a device fixing process of fixing said mortar peeling device to the peeling spot of the mortar in said concrete framework through said first fixing means is executed.

5. The mortar peeling method according to claim 2, wherein in said mortar peeling method, said movement process and said subsequent mortar peeling process are repeated, and after all the mortar as a peeling target is peeled off said concrete framework, a device removing process of removing said mortar peeling device off the peeling spot of the mortar is executed.

6. The mortar peeling method according to claim 5, wherein said first fixing means is composed of a first anchor fixed to an anchor hole drilled in said mortar and a pressing plate detachably fixed to a free end portion of said first anchor exposed from said anchor hole and pressing said guide member toward said mortar, and in said mortar peeling method, said first fixing means is attached in said device fixing process, and said first fixing means is removed in said device removing process.

7. The mortar peeling method according to claim 5, wherein said mortar peeling device includes second fixing means installed on a front end portion of said guide member and preventing movement of the guide member forward in one direction, and said second fixing means is composed of a first front end plate brought into contact with the front end portion of said guide member, a second front end plate connected to said first front end plate and brought into contact with said mortar, and a second anchor inserted into an anchor hole drilled in said mortar and fixing said second front end plate to the mortar, and in said mortar peeling method, said second fixing means is attached in said device fixing process, and said second fixing means is removed in said device removing process.

8. The mortar peeling method according to claim 5, wherein said peeling device includes third fixing means installed on a rear end portion of said guide member and preventing movement rearward in one direction of the guide member, and said third fixing means is composed of a first rear end plate brought into contact with a rear end portion of said guide member, a second rear end plate connected to said first rear end plate and brought into contact with said mortar, and a third anchor inserted into an anchor hole drilled in said mortar and fixing said second rear end plate to the mortar, and in said mortar peeling method, said third fixing means is attached in said device fixing process, and said third fixing means is removed in said device removing process.

9. The mortar peeling method according to claim 1, wherein said cutter is composed of a cutting edge located at a predetermined depth from an outer surface of said mortar and a mounting base connected to said cutting edge, and in said mortar peeling method, a top portion of said mounting base is slidably brought into contact with said the guide member and prevents movement of said cutter in a direction away from the outer surface of the mortar.

10. The mortar peeling method according claim 9, wherein in said mortar peeling method, by adjusting a dimension in a direction crossing one direction of said cutting edge, a peeling width of the mortar peeled off said concrete framework can be adjusted.

11. The mortar peeling method according to claim 1, wherein in said mortar peeling device, a sound pressure level generated in peeling of said mortar is within a range of 50 to 80 dB.

12. The mortar peeling method according to claim 1, wherein said jack is a hydraulic jack connected to an electric hydraulic jack.

* * * * *